US011691061B2

(12) United States Patent
Mazloompour

(10) Patent No.: US 11,691,061 B2
(45) Date of Patent: Jul. 4, 2023

(54) HEADS UP SPORTS TRAINING SYSTEM

(71) Applicant: Sehat Sporting Goods LLC, Edmond, OK (US)

(72) Inventor: Behnam Mazloompour, Edmond, OK (US)

(73) Assignee: Sehat Sporting Goods LLC, Edmond, OK (US)

( * ) Notice: Subject to any disclaimer, the term of this patent is extended or adjusted under 35 U.S.C. 154(b) by 0 days.

(21) Appl. No.: 17/410,669

(22) Filed: Aug. 24, 2021

(65) Prior Publication Data

US 2021/0379456 A1 Dec. 9, 2021

Related U.S. Application Data

(63) Continuation-in-part of application No. 16/707,675, filed on Dec. 9, 2019, now Pat. No. 11,097,179.

(60) Provisional application No. 62/917,465, filed on Dec. 7, 2018.

(51) Int. Cl.

| | |
|---|---|
| ***A63B 69/00*** | (2006.01) |
| ***A63B 67/00*** | (2006.01) |
| ***A63B 71/06*** | (2006.01) |

(52) U.S. Cl.

CPC ..... *A63B 67/002* (2013.01); *A63B 71/0622* (2013.01); *A63B 2225/20* (2013.01); *A63B 2225/74* (2020.08)

(58) Field of Classification Search

CPC ..... A63B 67/002; A63B 71/0622; A63B 2225/74; A63B 2224/20

USPC ..... 473/422, 446, 438, 470, 471, 476–478, 473/451; 463/36, 247; 482/1–9, 87, 482/900–902

See application file for complete search history.

(56) References Cited

U.S. PATENT DOCUMENTS

| | | | | |
|---|---|---|---|---|
| 4,645,458 | A | 2/1987 | Williams | |
| 7,951,045 | B1 * | 5/2011 | Brader | A63B 24/0062 482/3 |
| 10,039,967 | B2 * | 8/2018 | Dunser | A63B 69/002 473/446 |

(Continued)

FOREIGN PATENT DOCUMENTS

WO WO-2018132381 A1 * 7/2018 ..... A63B 69/34

OTHER PUBLICATIONS

European Search Report dated Jul. 13, 2022 in corresponding European Application No. 19893884.7.

*Primary Examiner* — Mitra Aryanpour
(74) *Attorney, Agent, or Firm* — K&L Gates LLP

(57) ABSTRACT

The sports training system includes a first housing including a transmitter; a second housing including a receiver and a wireless communication module; a plurality of illuminating targets in communication with the wireless communication module; and a remote control in wireless communication with the transmitter, the receiver, and the plurality of illuminating targets. In operation, the transmitter projects a transmission and the receiver is positioned laterally away from the transmitter and receives the transmission. In response to an object passing between the transmitter and receiver, the receiver is blocked from receiving the transmission. In response to the receiver being blocked from receiving the transmission, a selected one of the targets illuminates. Input from the remote control controls operation of one of the transmitter, the receiver, or one of the plurality of illuminating targets.

20 Claims, 16 Drawing Sheets

(56) References Cited

U.S. PATENT DOCUMENTS

| | | | | |
|---|---|---|---|---|
| 10,118,078 | B2 * | 11/2018 | Lewis | A63B 69/002 473/451 |
| 11,097,179 | B2 * | 8/2021 | Mazloompour | A63B 69/34 473/422 |
| 2007/0213126 | A1 * | 9/2007 | Deutsch | A63B 71/0686 473/422 |
| 2011/0148039 | A1 | 6/2011 | Klinnert | |
| 2016/0166905 | A1 * | 6/2016 | Dunser | A63B 69/002 473/446 |
| 2017/0095716 | A1 * | 4/2017 | Lewis | A63B 69/002 473/451 |
| 2019/0374843 | A1 * | 12/2019 | Elder | A63B 69/002 473/422 |

* cited by examiner

HEADS UP SPORTS TRAINING SYSTEM

CROSS-REFERENCE TO PRIOR APPLICATIONS

This application comprises a continuation-in-part of U.S. application Ser. No. 16/707,675 filed Dec. 9, 2019, which claims the benefit of priority to U.S. Provisional Application No. 62/917,465 filed Dec. 7, 2018, the entireties of which are incorporated by reference.

BACKGROUND OF THE INVENTION

The present subject matter relates generally to a sports training system. More specifically, the present invention relates to a sports training system in which a transmitter and receiver pair are wirelessly connected to a plurality of lighted indicators or targets such that, when the transmitter and receiver pair are triggered by a person any object passing between them (e.g., a person, a ball, etc.), one or more of the lighted indicators are illuminated.

There are many sports in which it is valuable for the player to keep his or her head up and eyes on the playing space such that the participant is able to maintain focus on the action rather than looking down at the ball, puck, the participant's feet, the ground, etc. Rather than being distracted by looking down, the participant benefits from being able to view the action and make quick decisions based on the information in front of him or her. This tends to be especially true while the player is moving through space.

In general, these sports activities include an object (e.g., ball, puck, etc.) and multiple targets, some stationary (e.g., bases, goals, etc.) and some in motion (e.g., other players, etc.), with which the moving player interacts (e.g., passes to, receives from, runs to, runs from, etc.). These sports activities often involve seemingly perpetual movement involving player choices dependent upon numerous circumstances and the near constant shifting of the player's focus and attention.

For example, when playing soccer, it is important for a player to be able to dribble the ball while looking forward and around to be able to see the action and make quick decisions as to where to move, to whom to pass, whether to shoot, etc. It is the same in hockey, where a player skating with the puck benefits from being able to see the ice in front of him or her to make those same decisions. In basketball, it is important for a player dribbling the ball to see the court, rather than looking down at the ball, again to see where to move, to whom to pass, whether to shoot, etc. In football, a quarterback dropping back to pass needs to be able to look down field to see the receivers and coverage, while also being able to see the pressure coming from the defense. Similarly, a running back or receiver must first watch the ball into his or her hands before looking up to scan the field to know where to run. In baseball, a player fielding the ball must be able to quickly survey the position of the baserunners and other fielders in order to throw the ball to the correct position on the field to secure an out, prevent a runner from advancing to another base, or preventing a run.

These skills take practice to develop. Certainly, these skills can be developed in games and game-like practices. However, in more complex environments, such as games and game-like practices, it can be difficult to isolate and focus on this just specific skill. There is value then, in having a training system that isolates this skill and enables players to work on moving while keeping their eyes up on the action and making quick decisions based on the play in front of them.

Accordingly, there is a need for a sports training system that helps players develop the skill of moving while keeping their head up and their eyes on the action in front of them, as described herein.

BRIEF SUMMARY OF THE INVENTION

To meet the needs described above and others, the present disclosure provides a sports training system that helps players to develop their ability to move through space while observing and responding to the activity around them.

In a primary embodiment, the sports training system includes a transmitter and receiver pair that are intended to be placed apart from each other. In a primary embodiment, the transmitter and receiver pair may be embodied in small housings intended to be stably placed on the ground. The transmitter projects an infrared beam of light to the receiver. When any object moves between the transmitter and the receiver (e.g., a person, a ball, etc.), the infrared beam of light is disrupted (i.e., the beam projected by the transmitter is not received by the receiver's sensor), which triggers the receiver to send a signal to one or more of a plurality of targets. The targets light up, or otherwise visually respond, in a manner to which the person is to react. Accordingly, as the person passes between the transmitter and receiver, the person must have his or her head up and eyes on the targets to know what to do next.

The targets may be cones, stakes, or similar stationary objects, each incorporating one or more lights or other visual indicators. In other examples, the target may be nets, hoops, goals, baskets, or other objects meant to receive a ball or other object directed by the player. The targets may be more complex objects that further incorporate movement or sound. For example, the targets may be people wearing one or more lights or other visual indicators. Similarly, the targets may be robots having one or more lights or may be holograms or other projections that can be shown as different colors.

In another embodiment, the sports training system includes a transmitter and receiver pair that are intended to be placed apart from each other. Again, the transmitter projects an infrared beam of light to the receiver. When a person moves between the transmitter and the receiver, the infrared beam of light is disrupted (i.e., the beam projected by the transmitter is not received by the receiver's sensor), which triggers the receiver to send a signal to a multi-color indicator. The multi-color indicator has a unique colored light corresponding to each of a plurality of unique colored targets. When the person trips the infrared beam, one or more of the lights on the multi-color indicator are illuminated, or otherwise visually respond, in a manner to which the person is to react. Accordingly, as the person passes between the transmitter and receiver, the person must have his or her head up and looking at the multi-color indicator to know what to do next.

The targets may be stationary targets that have a color indicator corresponding to a color on the multi-color indicator. Again, the targets may be cones, stakes, or similar stationary objects, each including a color or light or other visual indicator corresponding to a color on the multi-color indicator. In other examples, the target may be nets, hoops, goals, baskets, or other objects meant to receive a ball or other object directed by the player, also incorporating a color corresponding to a color on the multi-color indicator. Just as with the primary example above, the targets may be more complex objects that further incorporate movement or sound. For example, the targets may be people wearing one or more colors corresponding to a color on the multi-color indicator. Similarly, the targets may be robots having one or more color corresponding to a color on the multi-color indicator or may be holograms or other projections that can be shown as different colors.

In each of the above examples, the visual indicator may be integrated into the target, may be worn by or hung on the target, may be projected onto the target (e.g., a projector may project colors or symbols or patterns onto targets to perform the visual signal function), or may otherwise be more permanently or more temporarily associated with the target.

For example, in a soccer training drill, there may be a transmitter and a receiver spaced apart so a player may dribble a soccer ball between them. There may also be a pair of targets in front of the transmitter and receiver and also spaced apart from each other. Each of the targets may have one or more color of light it can indicate. When the player dribbles a soccer ball between the transmitter and receiver, the infrared signal is disrupted, and the receiver communicates to the targets causing them to light up. In one example, when the infrared beam is disrupted, a first target may turn green and a second target may turn red. In this drill, the player may be instructed to pass the ball in the direction of the green target. Which target turns green and which turns red may be a randomized event controlled by a controller (i.e., a processor and wireless communication transmitter) in the receiver. Accordingly, until the player passes between the transmitter and receiver, the player will not know which target will turn green and which will turn red. This requires the player to be looking up while dribbling through the transmitter and receiver to identify which target to pass to. In another example, rather than each target lighting a different color, only one of the targets lights up indication which direction the player should focus his or her attention. In yet another example, all of the targets may light which may signal that all of the targets are marked, and the player should not pass the ball.

Similarly, the above drill could be modified such that the player receives a pass in which the ball passes between the transmitter and receiver pair triggering the light response in the targets indicating to which target to pass the ball. As such, the drill teaches the player to receive the ball, quickly identify and make a pass to the randomly corresponding target.

In another example, there may be a primary player, four targets capable of displaying any one or more of four colors of lights, and four players wearing correspondingly colored jerseys. When the primary player passes between the transmitter and receiver, one of the target lights comes on directing the player to a position on the field (e.g., to the illuminated target) and which point the primary player passes the ball to the player wearing the jersey with the same color as the light.

The simple examples above illustrate the basic function of the sports training system described herein. More complex versions of the sports training system may be implemented. For example, there may be a greater number of targets, increasing the difficulty in identifying what action to take next (i.e., to which target to pass the ball). The number of light options on each target might be increased so as to signal a more complex series of decisions than simply "pass to one target and not to the other." For example, a multi-color lighting system may be used in each target such that each target might light any of four (or more) distinct colors and might indicate a series of actions to take. There may also be a series of transmitter and receiver pairs such that as the player moves through each successive pair, the player is directed by the targets to take a new action.

In a more complex example, as training for a quarterback, there may be a single transmitter and receiver pair communicating with four targets. The quarterback may start in front of the transmitter and receiver pair, take a snap, and take a drop (i.e., backpedal) through the transmitter and receiver pair. In response to the infrared light beam being disrupted, the receiver may trigger the four targets to light one at a time in succession. The quarterback would be instructed to look to each target as it lights up to simulate going through the progression of reads for the passing play. Similarly, each of the four targets may include a multi-color light capable of illuminating in any one of four colors. In such example, as the quarterback drops back through the transmitter and receiver pair, each of the four targets lights up with a different color with the intention of the quarterback having to "read" the targets in a certain order (e.g., first red, then yellow, then green, then blue). In yet another example, three of the targets may light a first color and the fourth target might light a distinct color, signaling the quarterback to throw the ball at the fourth target.

In an even more complex example, a first transmitter and receiver pair may be placed behind a quarterback as described above. As the quarterback drops through the first transmitter and receiver pair, one or more of a first set of targets light up directing the player to react. A second transmitter and receiver pair may be positioned outside of the passing pocket such that when the first set of targets light in a manner that directs the quarterback to run, the quarterback may run through the second transmitter and receiver pair, thereby causing one of a second transmitter and receiver pair to light to indicate which direction the quarterback is to cut to redirect path. For example, the second set of targets may be set downfield to the left and right of the second transmitter and receiver pair. As the quarterback passes through the second transmitter and receiver pair, one of the second set of targets lights to direct the quarterback to run to the left or to the right.

As noted above, the targets may be people wearing colored jerseys or elements that light up a specific color in response to the triggering of the transmitter and receiver pair. The flexibility of human targets, particularly with respect to their mobility and responsiveness, increases the system's complexity such that even more advanced training drills can be achieved.

The number of transmitter and receiver pairs, the number of associated targets, the number of colors each target may signal, the timing of the lighting and similar variables may all be manipulated to create simpler and more complex training exercises.

In some embodiments, the sports training system includes a remote control for triggering the visual indicators. In one example, the remote control includes a trigger activation control to activate and deactivate the trigger system, target activation controls to activate and deactivate individual lights, and a delay control to add, increase, or decrease a delay between the trigger activation and the light illumination. The controls may be used individually or in combination. The remote control may be a separate device that wirelessly communications with the receiver and transmitter pair and individual lights. In other embodiments, the remote may be embodied in a mobile application on a mobile device.

For example, a coach may have a handheld remote that can control which of the targets illuminates when an object passes through the transmitter and receiver.

In a more complex application, the targets may be smart targets that track the activity by the users. For example, the targets may include sensors that track the player's accuracy in the drills. In one example, each target may include a hoop, or similar goal, that identifies whether the ball has been passed through the goal in response to a corresponding visual indicator. The system may keep track of the player statistics and report to the mobile application such that the users have a record of the player's performance over time.

In one example, a sports training system includes: a first housing including a transmitter; a second housing including a receiver and a wireless communication module; a plurality of illuminating targets in communication with the wireless communication module; and a remote control in wireless communication with the transmitter, the receiver, and the plurality of illuminating targets. In operation, the transmitter projects a transmission and the receiver is positioned laterally away from the transmitter and receives the transmission. In response to an object passing between the transmitter and receiver, the receiver is blocked from receiving the transmission. In response to the receiver being blocked from receiving the transmission, a selected one of the targets illuminates. Input from the remote control controls operation of one of the transmitter, the receiver, or one of the plurality of illuminating targets.

In a further example, a sports training system includes a first housing including a transmitter; a second housing including a receiver and a wireless communication module; a multi-color indicator in communication with the wireless communication module; a plurality of colored targets corresponding to the colors on the multi-color indicator; and a remote control in wireless communication with the transmitter, the receiver, and the multi-color indicator. During use, the transmitter projects a transmission and the receiver is positioned laterally away from the transmitter and receives the projected transmission. In response to an object passing between the transmitter and receiver, the receiver is blocked from receiving the projected transmission. In response to the receiver being blocked from receiving the projected transmission, a selected one of the colors on the multi-color indicator illuminates. Input from the remote control controls operation of one of the transmitter, the receiver, and the multi-color indicator.

In some embodiments, the input from the remote control deactivates or deactivates the transmitter and the receiver. For example, the input from the remote control stops the transmitter from projecting the transmission. In other embodiments, the input from the remote control activates or deactivates one of the plurality of illuminating targets.

In some embodiments, the selected one of the targets is illuminated immediately in response to the receiver being blocked from receiving the projected transmission. In other embodiments, the input from the remote control generates a delay in the illumination of the selected one of the targets in response to the receiver being blocked from receiving the projected transmission. The delay may have a length of between about 0.5 seconds and 9 seconds. Further input from the remote control adjusts the length of the delay.

In some embodiments, the projected transmission is an infrared beam. In each of the examples above, the selection of one of the targets or colors to illuminate may be random or pseudo-random. The selection of one of the targets to illuminate may be directed by an input from a remote control. The remote control may be a mobile device. The transmitter and the receiver may each include a base, a cap, and a leveling mechanism that enables the cap to be repositioned with respect to the base to align for communication between the transmitter and the receiver. The projected transmission may be an infrared beam.

In a still further embodiment, a method of using a sports training system is provided. The method includes the steps of providing a sports training system including a first housing including a transmitter; a second housing including a receiver and a wireless communication module; one of a plurality of illuminating targets or a multi-color indicator in communication with the wireless communication module and a plurality of colored targets corresponding to the colors on the multi-color indicator; and a remote control in wireless communication with the transmitter, the receiver, and the one of the plurality of illuminating targets or the multi-color indicator. The method includes the steps of projecting a transmission from the transmitter to the receiver; receiving the transmission in the receiver; in response to an object passing between the transmitter and receiver, illuminating one of a target of the plurality of illuminating targets or the multi-color indicator; and controlling operation of one of the transmitter, the receiver, and the one of the plurality of illuminating targets or the multi-color indicator through input received by the remote control.

An object of the present system is to improve a player's ability to focus on the action in front and around them.

Another object of the present system is to improve a player's anticipation by training the user to focus on receipt and redirection of the sports object to a subjective and random target subsequent to receipt during the time that the sports object is in the process of arriving.

An advantage of the present system is that it may be operated with or without the assistance of another person, depending upon the setup of the system.

Another advantage of the present system is that it is scalable to be configured for simpler or more complex training scenarios.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

The following detailed description provides examples of implementations of the sports training system. Although the examples provided below mainly focus on training drills related to soccer, it is understood that the systems provided herein may be applied to training in many sports, including, but not limited to, soccer, hockey, football, baseball, and basketball. In general, the teachings provide herein may be applicable to skills training for any athletic activity that involves objects, targets, and player reaction based on the observation of the environment.

Figure 1:
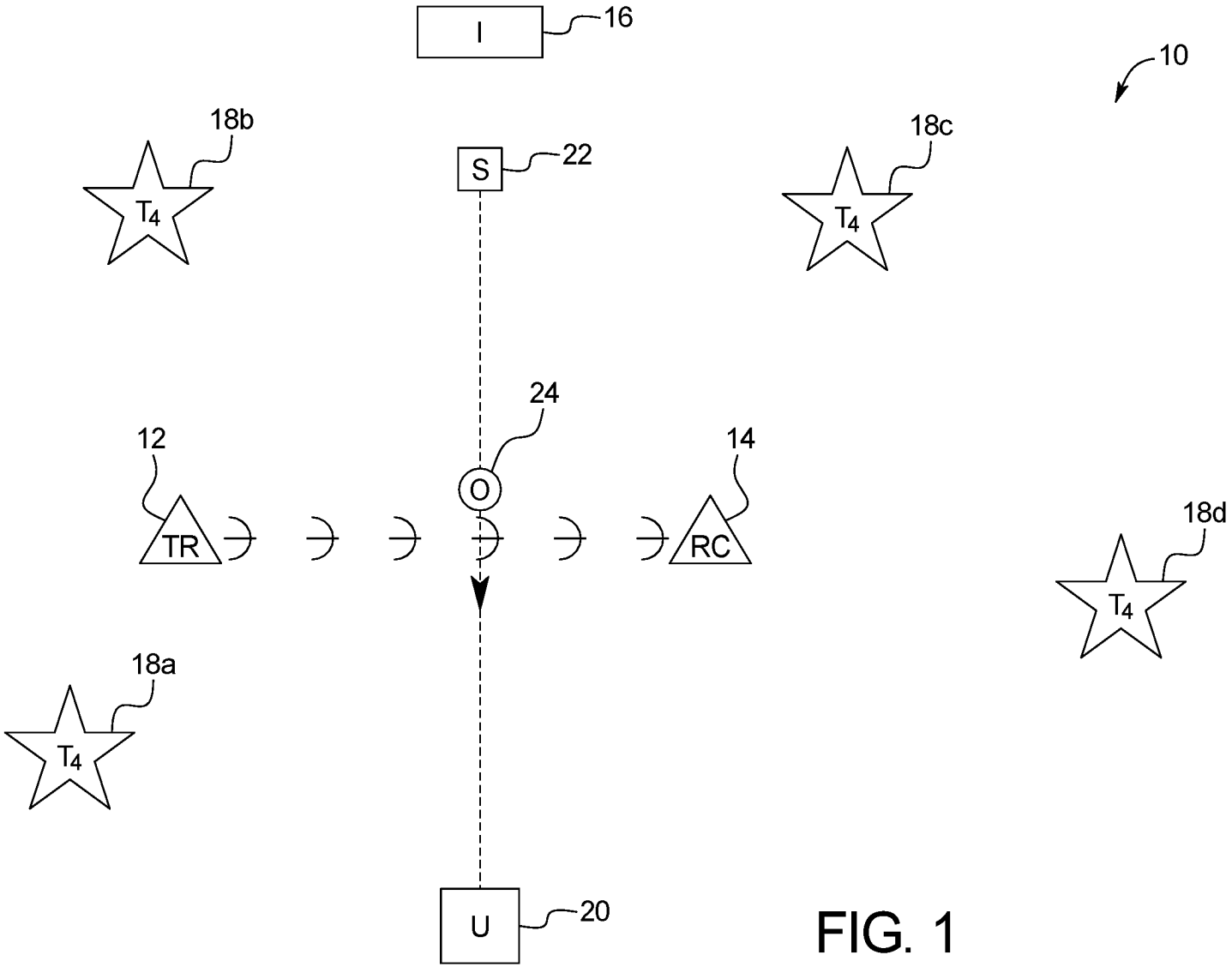
FIG. 1 is a schematic representation of an example of a sports training system.

FIG. 1 is a schematic representation of a first example of a sports training system 10. As shown in FIG. 1, the sports training system 10 includes a transmitter 12, a receiver 14, a multi-color indicator 16, four targets 18*a*-18*d*, a first player 20, a second player 22, and a ball 24.

In the example shown in FIG. 1, the transmitter 12 projects an IPLED beam towards the receiver 14, which receives the IPLED beam. The communication between the transmitter 12 and the receiver 14 is continuous, creating a space between the transmitter 12 and the receiver 14 through which any passing object, such as the ball 24, will break the communication between the transmitter 12 and the receiver 14. A break in the communication between the transmitter 12 and the receiver 14 causes a wireless communication module 30 in the receiver 14 to send a signal to the multi-color indicator 16.

A processor 32 is located in either the receiver 14 (see, FIG. 5*b*) or the multi-color indicator 16. When the processor 32 is located in the receiver 14, the processor 32 determines what signal to send to the multi-color indicator 16. When the processor 32 is located in the multi-color indicator 16, the processor 32 determines how to respond to the signal received. In either instance, the communication of the signal from the receiver 14 to the multi-color indicator 16 causes a scripted, random, or pseudo-random color to light on the multi-color indicator 16. The color corresponds to one of the four targets 18*a*-18*d*. In this example, each of the four targets 18*a*-18*d* has a fixed color association. For example, the first target 18*a* may be red, the second target 18*b* may be yellow, the third target 18*c* may be green, and the fourth target 18*d* may be blue.

In use, the second player 22 passes the ball to the first player 20. As the ball 24 passes between the transmitter 12 and the receiver 14, the communication between them is broken and the receiver 16 sends a signal to the multi-color indicator 16. In response, the multi-color indicator 16 lights up a random color. In this example, the multi-color indicator 16 lights up as yellow, which corresponds to the second target 18*b*. Accordingly, as the first player 20 receives the pass from the second player 22, the multi-color indicator 16 lights up yellow to indicate to the first player 20 to pass the ball 24 in the direction of the second target 18*b*. Neither the first player 20, nor the second player 22 knows in advance which target or colored light will be selected by the processor 32.

Figure 2:
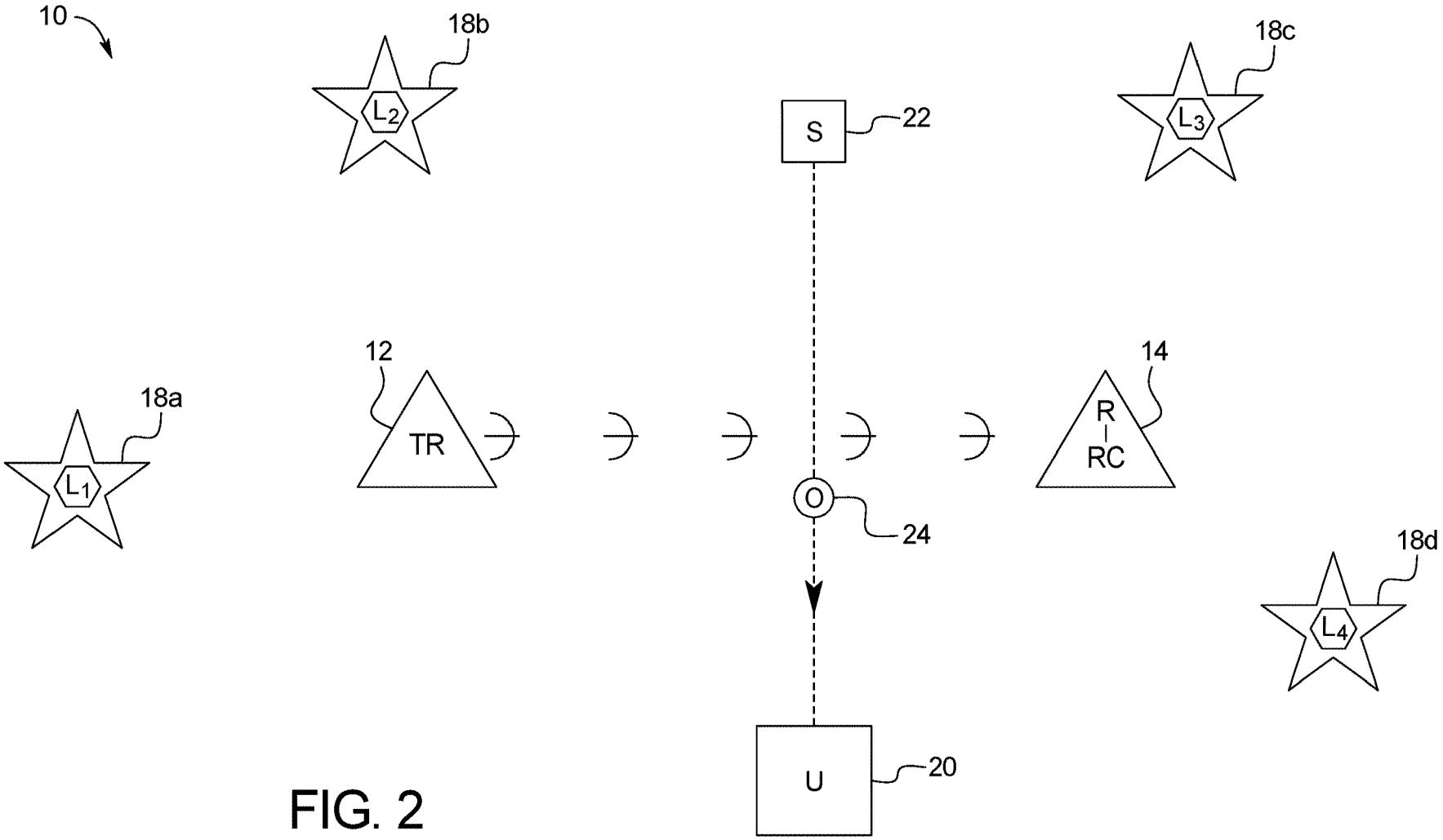
FIG. 2 is a schematic representation of another example of a sports training system.

FIG. 2 is a schematic representation of a second example of a sports training system 10. As shown in FIG. 2, the sports training system 10 includes a transmitter 12, a receiver 14, four targets 18*a*-18*d*, a first player 20, a second player 22, and a ball 24.

In the example shown in FIG. 2, the transmitter 12 projects an IPLED beam towards the receiver 14, which receives the IPLED beam. The communication between the transmitter 12 and the receiver 14 is continuous, creating a space between the transmitter 12 and the receiver 14 through which any passing object will break the communication between the transmitter 12 and the receiver 14. A break in the communication between the transmitter 12 and the receiver 14 causes a wireless communication module 30 in the receiver 14 to send a signal to one of the four targets 18*a*-18*d*. The selection of the target 18 is made by the processor 32 in the receiver 14. The selection may be scripted, or it may be random or pseudo-random. The target 18 receiving the signal lights up. Each target 18 may have one or more lights that can visually signal in one or more colors.

In use, the second player 22 passes the ball to the first player 20. As the ball 24 passes between the transmitter 12 and the receiver 14, the communication between them is broken and the receiver 16 sends a signal to a random one or the targets 18*a*-18*d*. In this example, the signal is sent to the third target 18*c*. Accordingly, as the first player 20 receives the pass from the second player 22, the third target 18*c* lights indicating that the first player 20 is to pass the ball 24 in the direction of the third target 18*c*.

Figure 3:
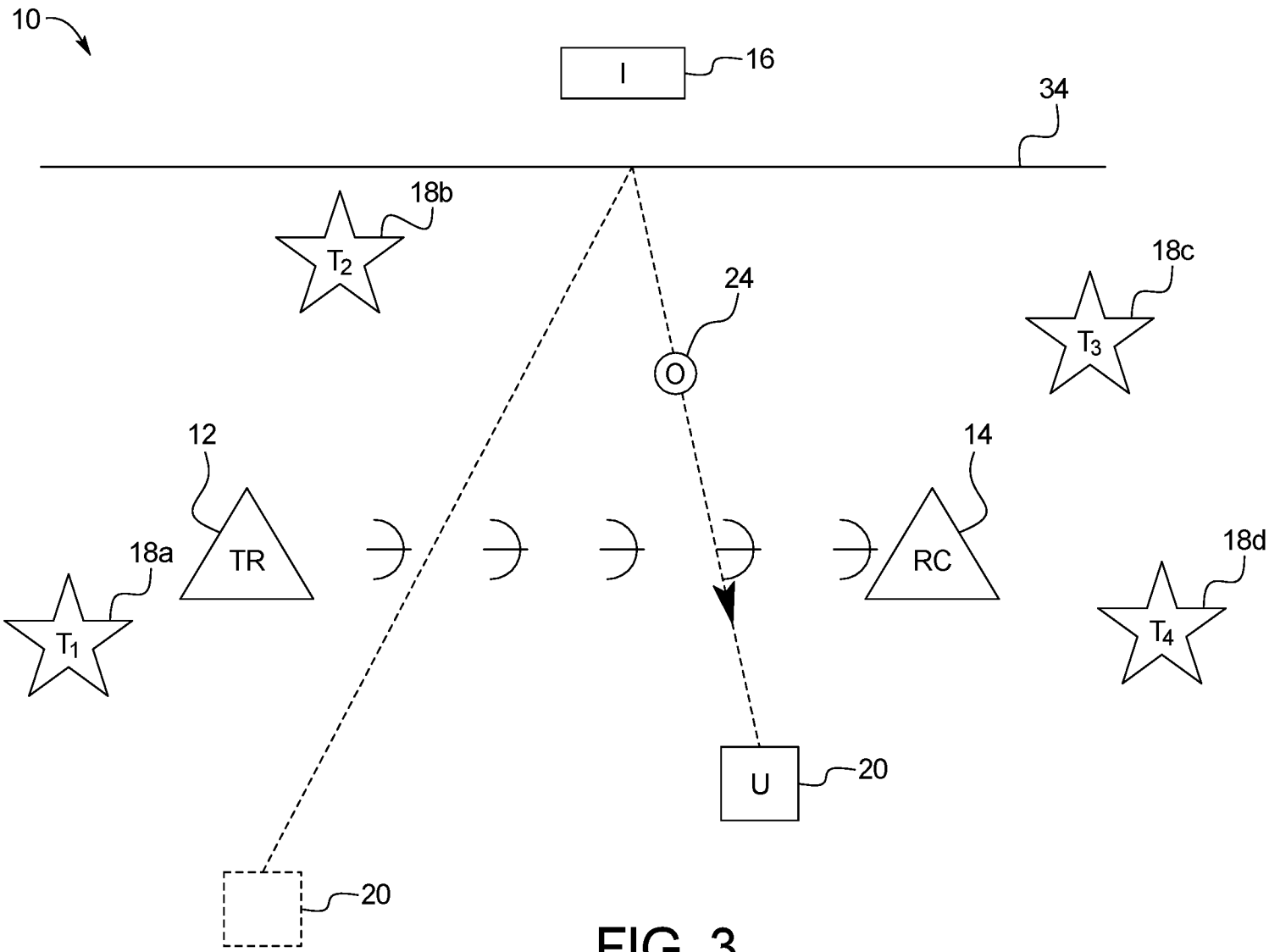
FIG. 3 is a schematic representation of another example of a sports training system.

FIG. 3 is a schematic representation of a third example of a sports training system 10. As shown in FIG. 3, the sports training system 10 includes a transmitter 12, a receiver 14, a multi-color indicator 16, four targets 18*a*-18*d*, a first player 20, a second player 22, a ball 24, and a rebounding surface 34.

This example is similar to the example shown in FIG. 1, only there is no second player 22, the first player instead passes the ball 24 to himself or herself by kicking it off of a rebounding surface 34, such as, for example, a wall or a rebounding device such as the one sold under the trademark SOCCERWAVE. Accordingly, when the first player 20 kicks the ball 24 off the rebounding surface 34, the ball 24 may break the communication between the transmitter 12 and receiver 14 two times. In such cases, the wireless communication module 30 may communicate its signal in response to the first or second break in communication between the transmitter 12 and receiver 14.

Figure 4:
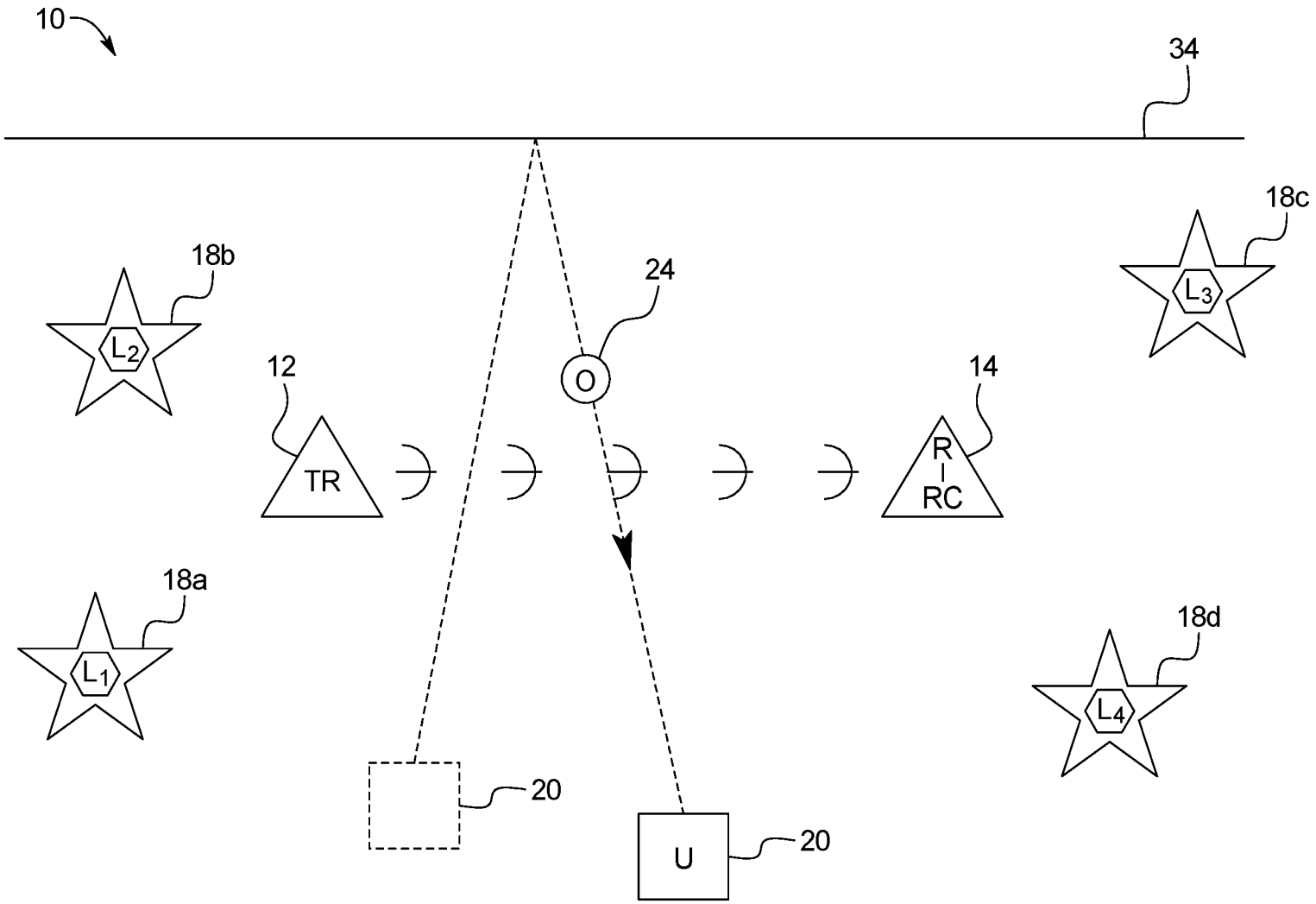
FIG. 4 is a schematic representation of another example of a sports training system.

FIG. 4 is a schematic representation of a fourth example of a sports training system 10. As shown in FIG. 4, the sports training system 10 includes a transmitter 12, a receiver 14, four targets 18*a*-18*d*, a first player 20, a ball 24, and a rebounding surface 34.

This example is similar to the example shown in FIG. 2, only there is no second player 22, the first player instead passes the ball 24 to himself or herself by kicking it off of a rebounding surface 34. Again, the ball 24 may break the communication between the transmitter 12 and receiver 14 two times. In such cases, the wireless communication module 30 may communicate its signal in response to the first or second break in communication between the transmitter 12 and receiver 14.

Figure 5A:
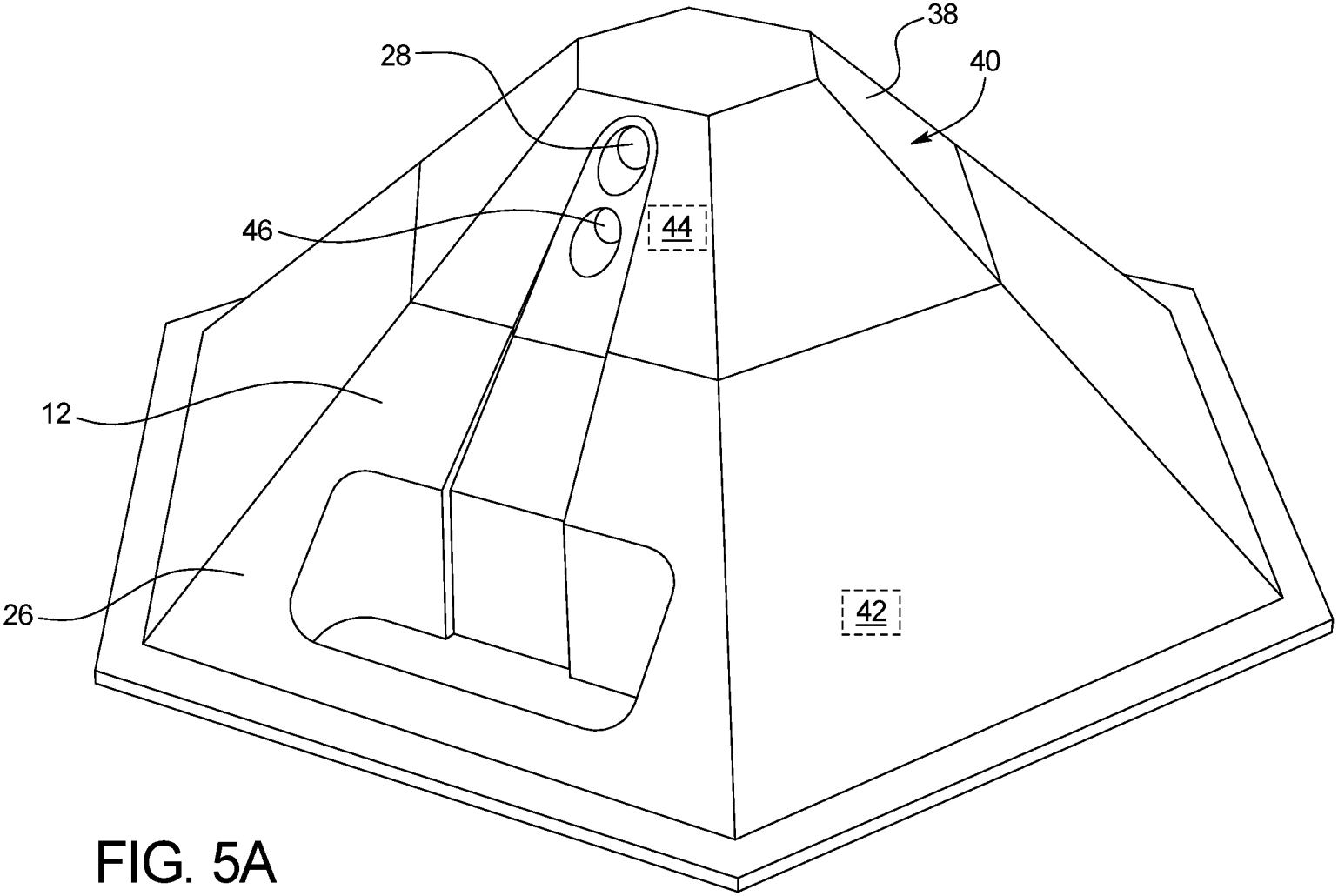
FIG. 5*a* is a perspective view of a transmitter.

FIG. 5*a* is a perspective view of a transmitter 12. The transmitter 12 includes a base 36, a cap 38 mounting upon the base 36, an adjustment mechanism 40 to level and finely position the cap 38 (e.g., a multipoint leveling adjuster), an inner rechargeable power supply 42, and a transmitter signal device 44 and a transmitter lens 46 integrated within the cap 38. A power switch 28 is shown above the transmitter lens 46.

Figure 5B:
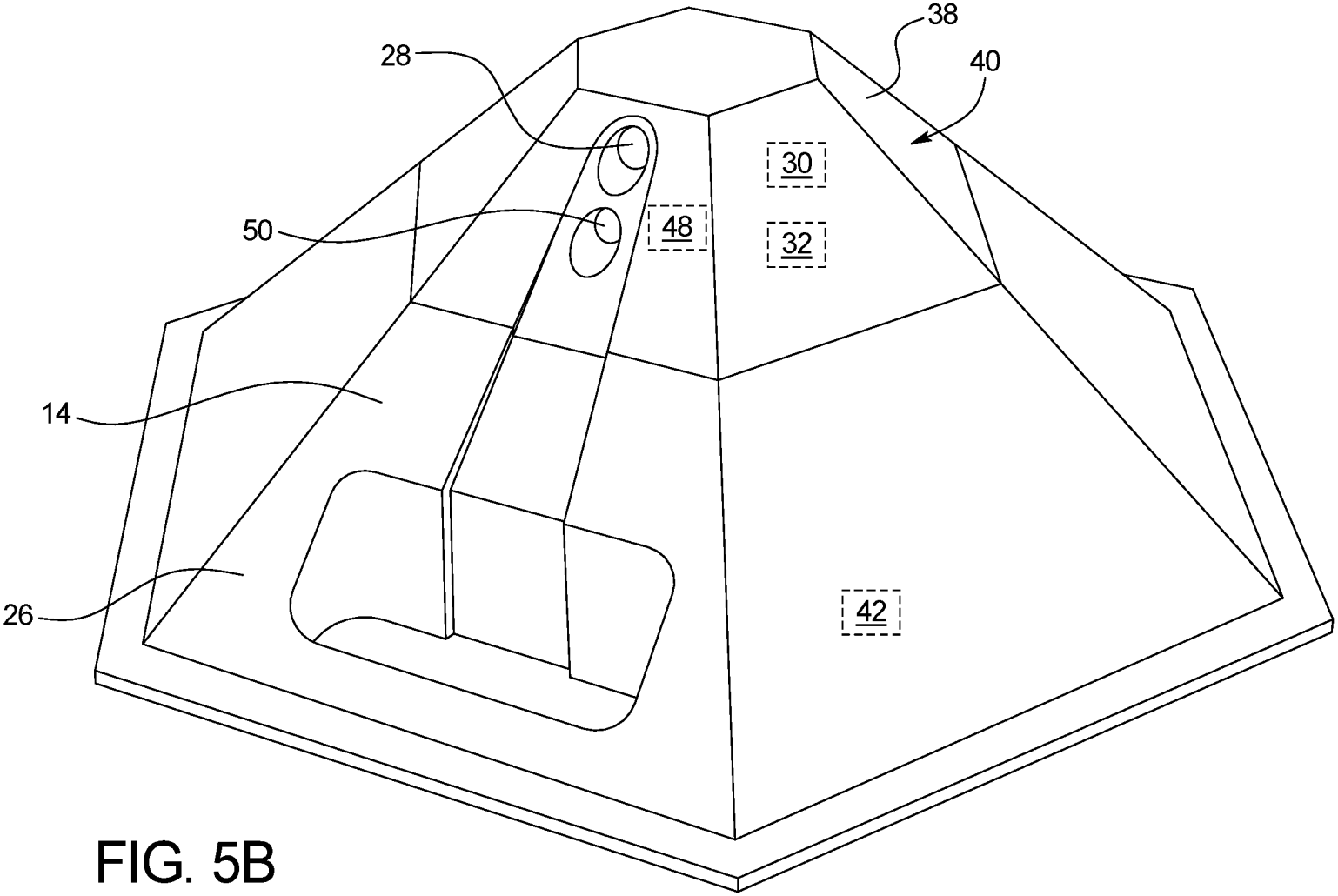
FIG. 5*b* is a perspective view of a receiver.

FIG. 5*b* is a perspective view of a receiver 14. The receiver 14 includes a base 36, a cap 38 mounting upon the base 36, an adjustment mechanism 40 to level and finely position the cap 38 (e.g., a multipoint leveling adjuster), an inner rechargeable power supply 42, and a receiver signal device 48 with a receiver lens 50 integrated within the cap 38. In addition, the receiver 14 includes the wireless communication module 30 and processor 32, as described above with respect to FIGS. 1-4. A power switch 28 is shown above the receiver lens 50.

Figure 6:
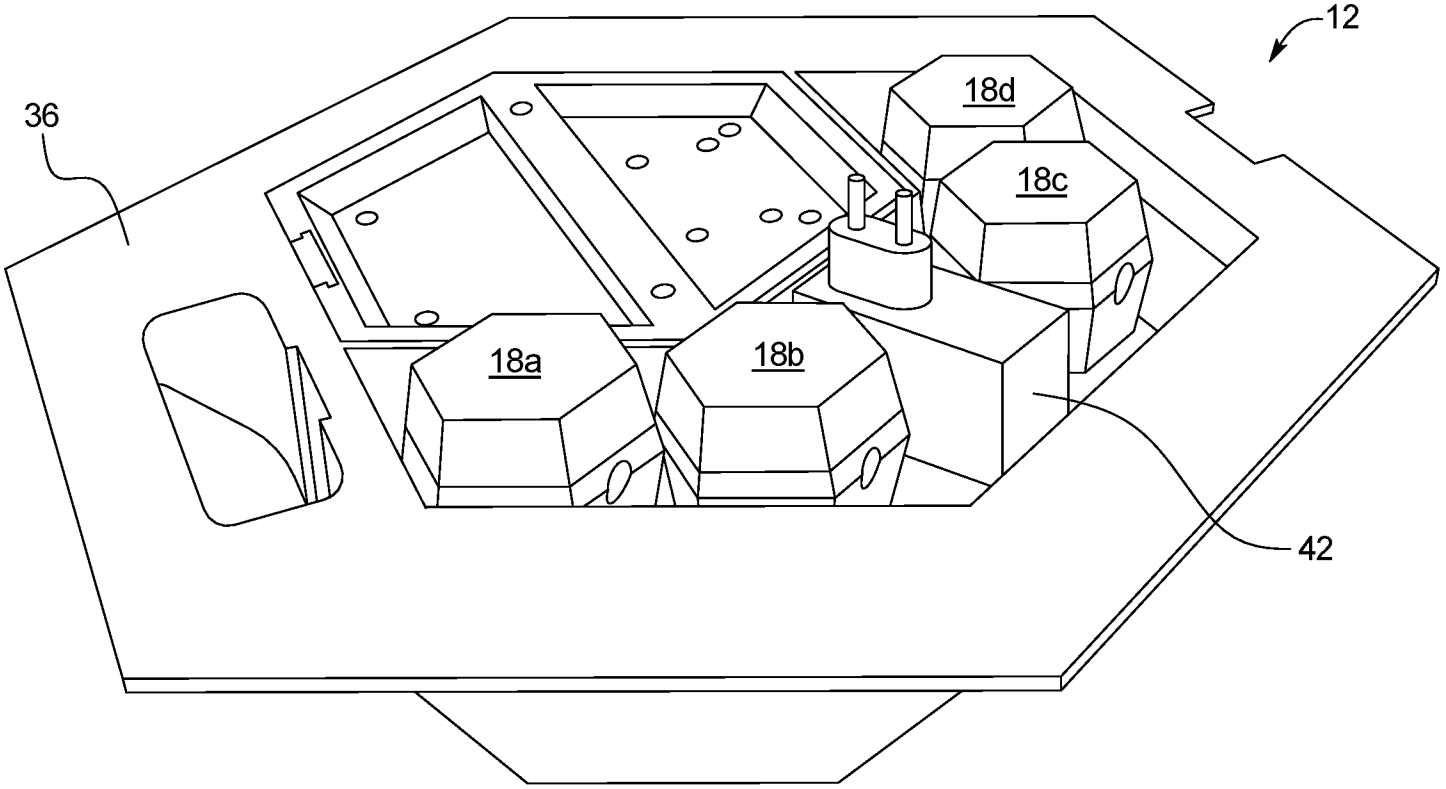
FIG. 6 is a perspective view of the bottom of the transmitter and receiver shown in FIG. 5.

FIG. 6 illustrates the bottom of the transmitter 12 shown in FIG. 5*a*. As shown in FIG. 6, the base 36 may be used to hold the power supply 42 and the targets 18*a*-18*d*. In this example, the targets 18*a*-18*d* are lights.

As shown in FIGS. 1-4, in use, the transmitter 12 and receiver 14 are placed on the ground with the transmitter lens 46 and receiver lens 52 directed towards one another. The adjustment mechanism 40 on each of the transmitter 12 and receiver 14 provides fine adjustment with which to finalize the transmitter lens 46 and receiver lens 52 alignment. A wireless signal beam, preferably an IRLED signal similar to that used in television remote signal transmission, has been found most reliable, but other FCC approved transmission signals are contemplated. The signal is sent and received by the respective transmitter 12 and receiver 14 with power supplied through the respective rechargeable power supplies 42. This signal is constant once activated. The ball 24, when passing through the wireless signal beam, interrupts the signal, which electronically triggers the receiver 14 to activate the wireless communication module 30 to send a signal transmission to the multi-color indicator 16 or one or more of the four targets 18.

The targets 18 may be basic stationary targets 18 that have some color indicator corresponding to the colors of the multi-colored indicator 16. The targets 18 can be simple cones with a colored fabric drape, a stake with a colored plate, a net, or some other colorized device for the first player 20 to aim towards. In another example, the targets 18 may include a light that is illuminated when a signal is received from the wireless communication module 30.

As noted above, the barrier or rebounding surface 34 associated with the single user embodiments may be something as simple as a wall, the side of a house, or a more sophisticated sports device. Some examples of these more challenging self-return devices include the soccer ball return training device sold under the trademark SOCCERWAVE, a pitch-back screen used for baseball or softball, an elastic panel associated with hockey puck return, etc.

The signal transmitted by the transmitter 12 and received by the receiver 14 may be any wireless signal known in the art or arising in the future, including short range FM, RF, infrared signal, low frequency short wave signal, laser, WiMAX, Wi-Fi, Bluetooth, LAN or ZigBee. This is not an exhaustive list of wireless transmission signaling devices or technologies.

FIGS. 7*a*-7*b*, 8*a*-8*b*, and 9*a*-9*c* each illustrate examples of the sports training system 10 in use. These examples are non-exhaustive, but help to illustrate to those skilled in the art various ways in which the sports training system 10 may be used.

Figure 7A:
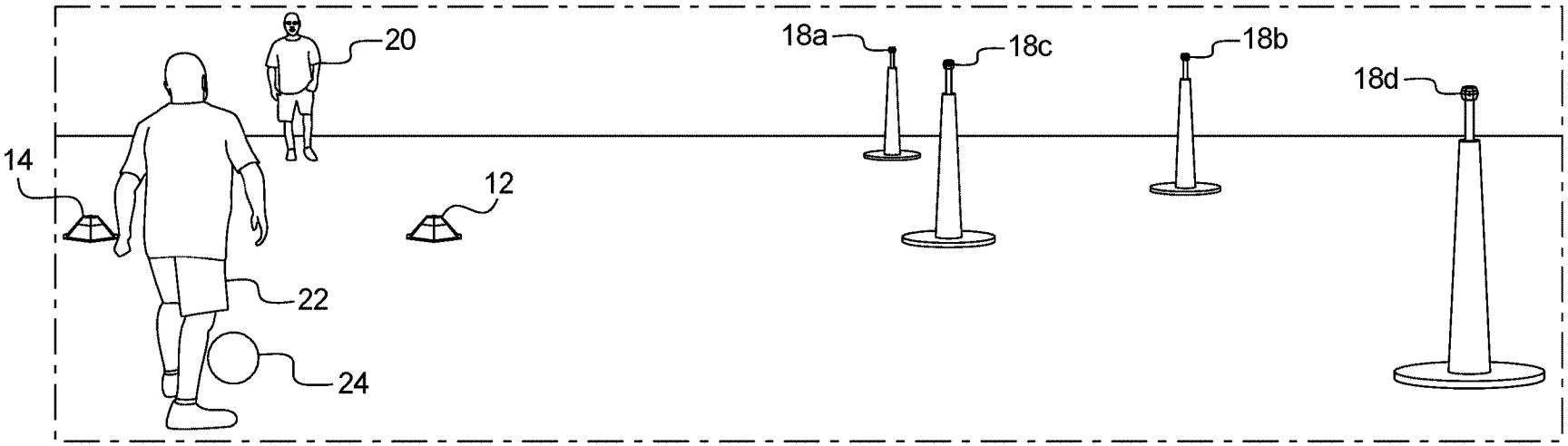
FIGS. 7*a*-7*b* illustrate an application of a sports training system as a soccer training drill.

In the example shown in FIG. 7*a*, a first player 20 is positioned to receive a pass from a second player 22. The transmitter 12 and receiver 14 are positioned such that the pass from the second player 22 to the first player 20 will trigger one of the four targets 18*a*-18*d*.

Figure 7B:
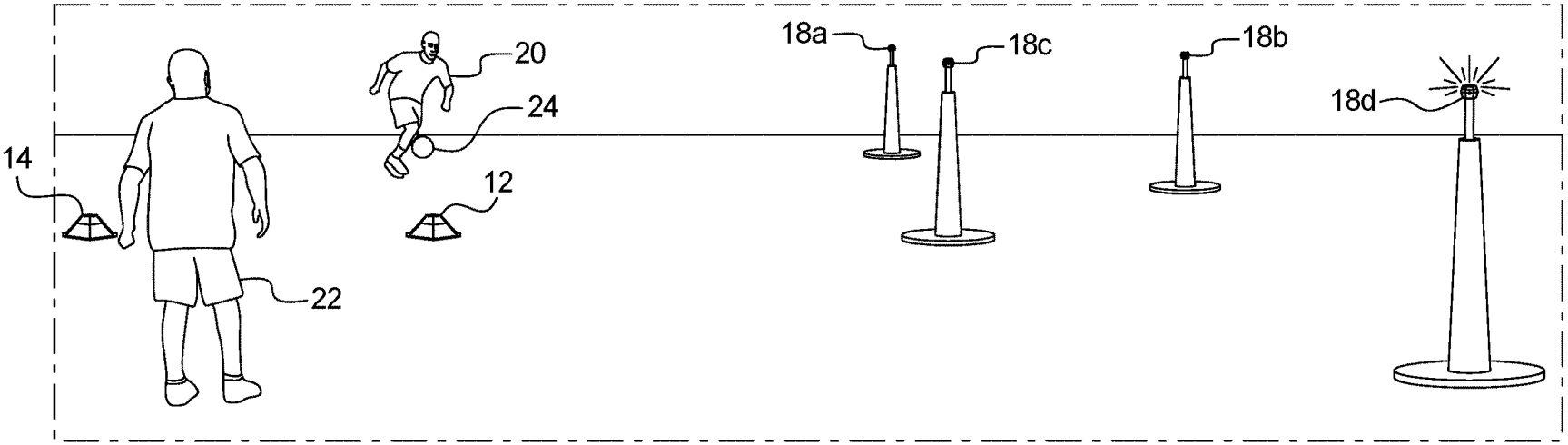

As shown in FIG. 7*b*, after the soccer ball 24 has passed through the transmitter 12 and receiver 14, the fourth target 18*d* illuminates and the player is directed to dribble or pass towards the fourth target 18*d*.

Figure 8A:
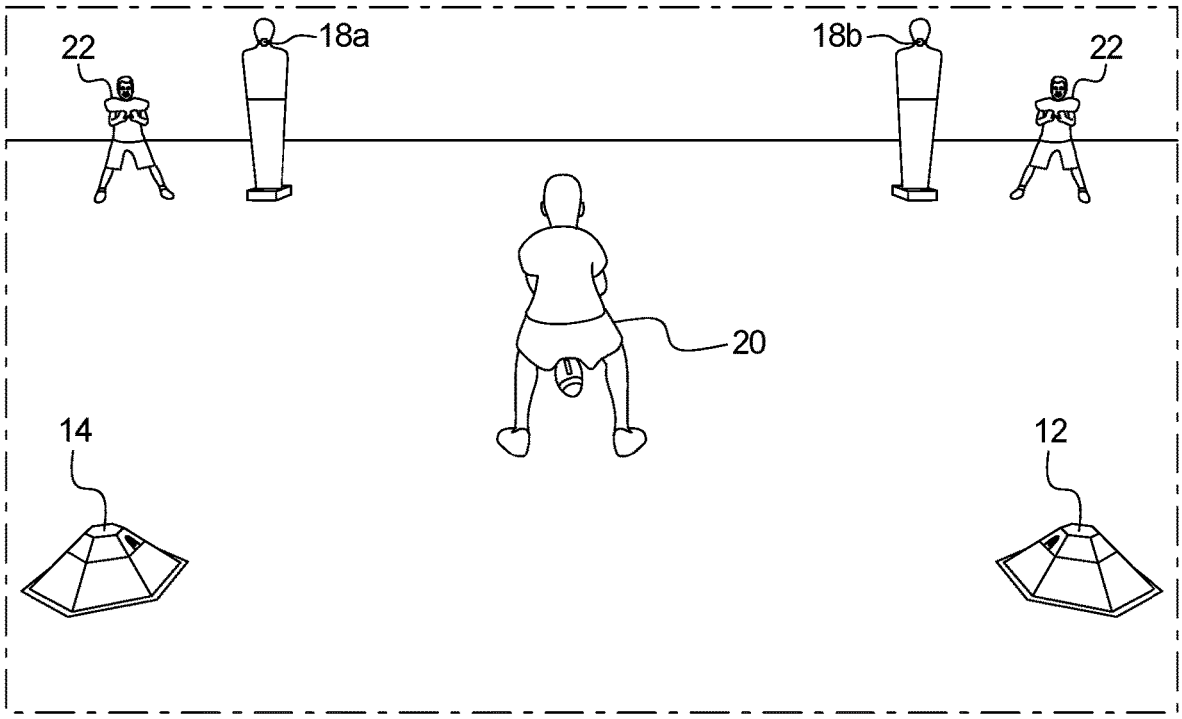
FIG. 8*a*-8*b* illustrate an application of a sports training system as a football passing training drill.
Figure 8B:
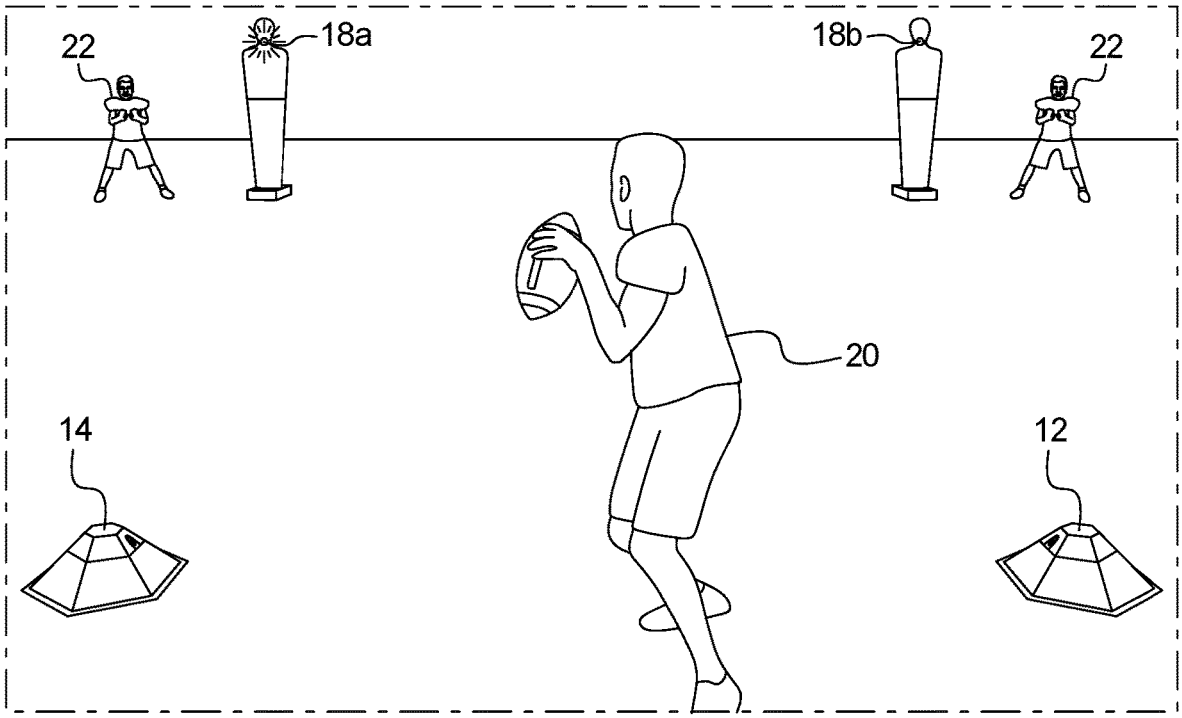

In the example shown in FIGS. 8*a* and 8*b*, there is a first player 20 and two second players 22. The transmitter 12 and receiver 14 are positioned such that as the first player 20 (e.g., the quarterback) drops back to pass, one of the two targets 18*a*-18*b* illuminates and the first player 20 is directed to pass the football to the second player 22 adjacent the illuminated target 18*a*.

Figure 9A:
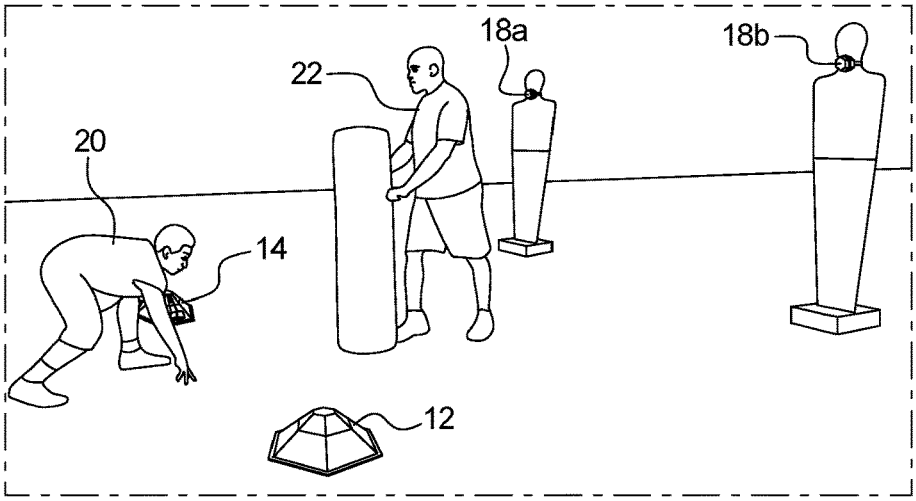
FIGS. 9*a*-9*c* illustrate an application of a sports training system as a football blocking training drill.
Figure 9B:
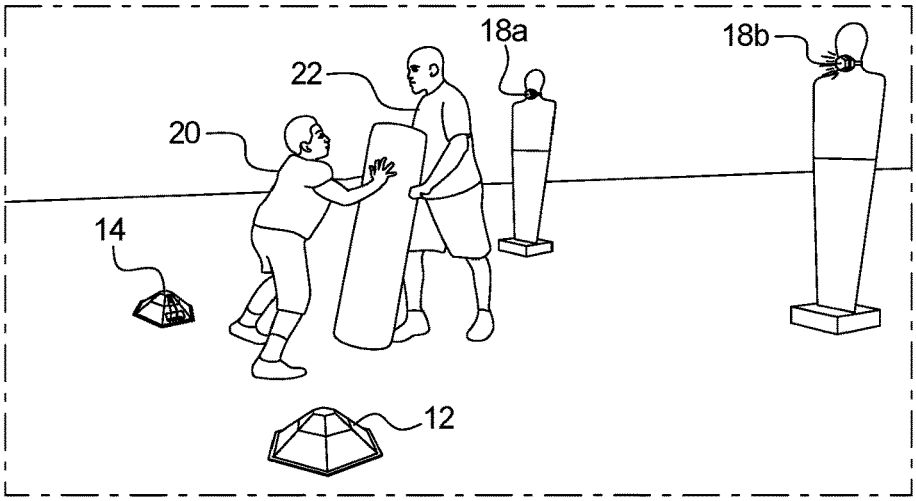
Figure 9C:
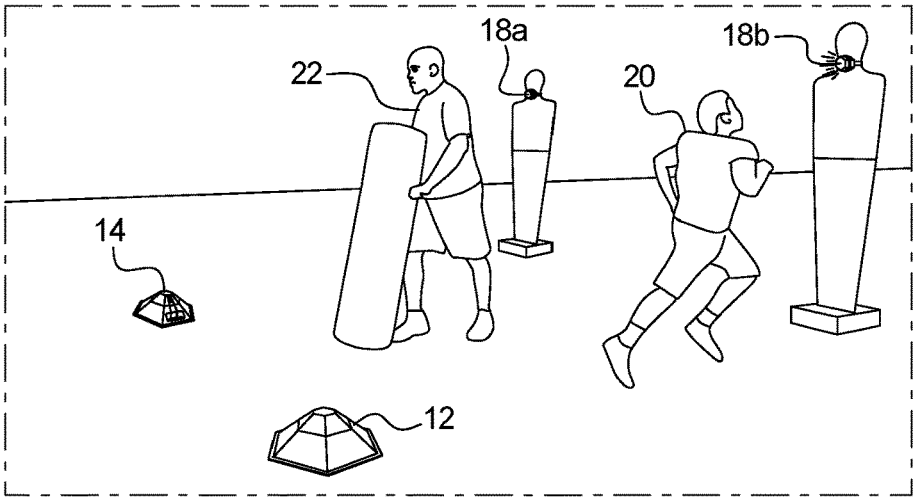

In the examples shown in FIG. 9*a*-9*c*, there is a first player 20 and a second player 22. The transmitter 12 and receiver 14 are positioned such that when the first player 20 comes out of his stance to hit the dummy held by the second player 22, one of the two targets 18*a*-18*b* illuminates and the first player 20 is directed to run towards the illuminated target 18*b* after shedding the block.

In a further example, each color of the targets 18*a*-18*d* corresponds to a further drill such as running an agility ladder, jumping high knees above a series of cone, and jumping hurdles. A first player 20 passes the ball 24 to the second player 22, breaking the communication between the transmitter and receiver pair 12, 14 in the process and causing one of the four targets 18*a*-18*d* to be randomly illuminated. The second player 22 receiving the ball 24 calls out the color of the target 18*a*-18*d* illuminated and immediately runs to the corresponding further drill.

Figure 10:
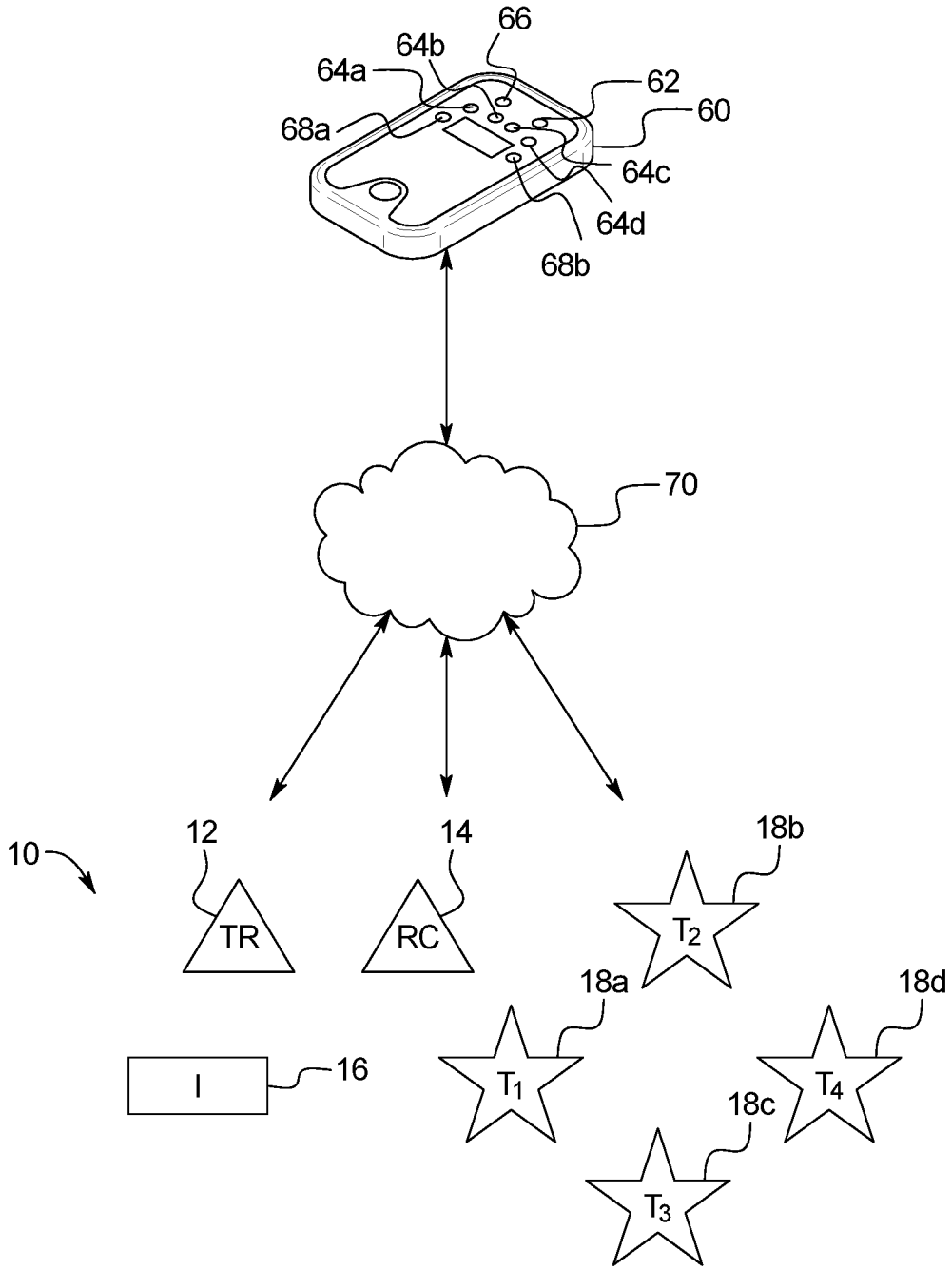
FIG. 10 illustrates the communications of the sports training system of FIG. 1.

Alternatively, or in addition to the elements described above, the system 10 may include a remote control 60 as shown in FIG. 10 to control operation of the transmitter 12, the receiver 14, the multi-color indicator 16, or the illuminating targets 18*a*-18*d*. The remote control 60 may be used by the second player 22 (e.g., a coach or training partner) to control which colored light on the multi-colored indicator 16 or light on the selected target 18 is illuminated, as opposed to an automated random selection created by the processor 32, and/or to control operation of the transmitter and receiver pair 12, 14. Similarly, an application may be provided on a mobile device allowing the third-party (i.e., second player 22, coach, training partner, etc.) the features and functions of the remote control 60.

As shown in FIG. 10, the remote control 60 communicates with the multi-colored indicator 16 and/or the selected targets 18*a*-18*d* using a conventional wireless communication protocol 70 such as infrared light, Bluetooth, Wi-Fi, or other available suitable technology.

The remote control 60 includes a trigger activation control 62 to activate and deactivate (i.e., enable and disable) the trigger system of the transmitter and receiver pair 12, 14. When the trigger system of the transmitter and receiver pair 12, 14 is active/enabled, an object passing between the transmitter 12 and receiver 14 pair to break the communication between the transmitter and receiver pair 12, 14 triggers system functions. When the trigger system of the transmitter and receiver pair 12, 14 is deactivated/disabled, an object passing between the transmitter 12 and receiver 14 pair to break the communication between the transmitter and receiver pair 12, 14 does not trigger system functions. For example, deactivation of the trigger system may include stopping the transmitter 12 from projecting the transmission to be received by the receiver 14 or stopping the indicator 16 or the target 18*a*-18*d* from being illuminated in response to the receiver 14 being blocked from receiving the transmission from the transmitter 12.

Target activation controls 64*a*-64*d* on the remote control 60 are used to activate and deactivate the targets 18*a*-18*d* individually. The number of target activation controls 64*a*-64*d* may correspond to the number of targets 18*a*-18*d* to provide one-to-one control of each target 18*a*-18*d*.

Alternatively, or additionally, the remote control 60 may include a multicolor indicator control to activate or deactivate the indicator 16.

Delay controls 68*a*, 68*b* is provided to add, increase, or decrease a delay between the trigger activation at the transmitter and receiver pair 12, 14 and the illumination of the target 18*a*-18*d*. For example, when the trigger system of the transmitter and receiver pair 12, 14 is active/enabled, an object passing between the transmitter 12 and receiver 14 pair to break the communication between the transmitter and receiver pair 12, 14 triggers designated system functions. Whether the system functions are triggered immediately or on a delay, and a length of the delay, can be controlled by the user through the delay controls 68*a*, 68*b*.

In other embodiments, the remote control 60 can control additional features of the sports training system 10, such as, but not limited to, a color selection at a specific target 18*a*-18*d*.

During use, a coach or other third party may begin a drill that utilizes the random selection of individual targets 18*a*-18*d* caused by the triggering at the transmitter and receiver pair 12, 14. As the drill proceeds, the coach may determine that the player 20 needs more practice with paying attention to one of the four targets 18*a*-18*d* in particular. The coach may use one of the target activation controls 64*a*-64*d* to activate the corresponding target 18*a*-18*d* individually. Additionally, the coach may also use the trigger activation control 62 to deactivate the trigger system 12, 14 such that the coach may use the remote 30 to manually activate the targets 18*a*-18*d* using the target activation controls 36*a*-36*d*.

In another example, using the delay controls 68, the coach may add a delay to the triggering of the system by the transmitter and receiver units 12, 14. By delaying the illumination of the target 18*a*-18*d*, the player 20, 22 receiving the pass must simultaneously protect the ball from other players while keeping their head up to watch for a target 18*a*-18*d* to be illuminated. The delay provides the players 20, 22 with additional practice in keeping their head up during the entire length of the delay while protecting the ball and allows the coach to observe the player's response.

The delay control 68 may be used when the receiver and transmitter pair 12, 14 activated or deactivated. For example, when the receiver and transmitter pair 12, 14 is activated, the delay occurs between the triggering of the target 18*a*-18*d* and the illumination of the target 18*a*-18*d*. When the receiver and transmitter pair 12, 14 is deactivated, the delay occurs between the coach's selection of the target activation control 68*a*-68*d* and the illumination of the selected individual target 18*a*-18*d*.

In one embodiment, the remote control 60 enables the coach or third party to adjust the delay using the delay controls 68*a*, 68*b* in half second increments between 0 and 9 seconds. For example, this adjustability gives the coach the option to select a shorter or longer delay based on the receiving player's level of experience. For example, a newer player may need a longer delay during the drill to make the pace of the drill more manageable.

In other embodiments, the remote control 60 may include a control 66 that enables the coach or a third party user to adjust the length of time that the selected target 18 is illuminated. Each target 18 may have a default duration of illumination of, for example, 2 seconds. The illumination time may be shortened or lengthened through one or more controls 66. This adjustability gives the coach the option to select a shorter or longer duration of illumination based on the receiving player's level of experience. For example, a relatively new player may need a longer duration of illumination of 6 seconds while an experienced player may be challenged by a shorter duration of illumination of 1 second.

Figure 13A:
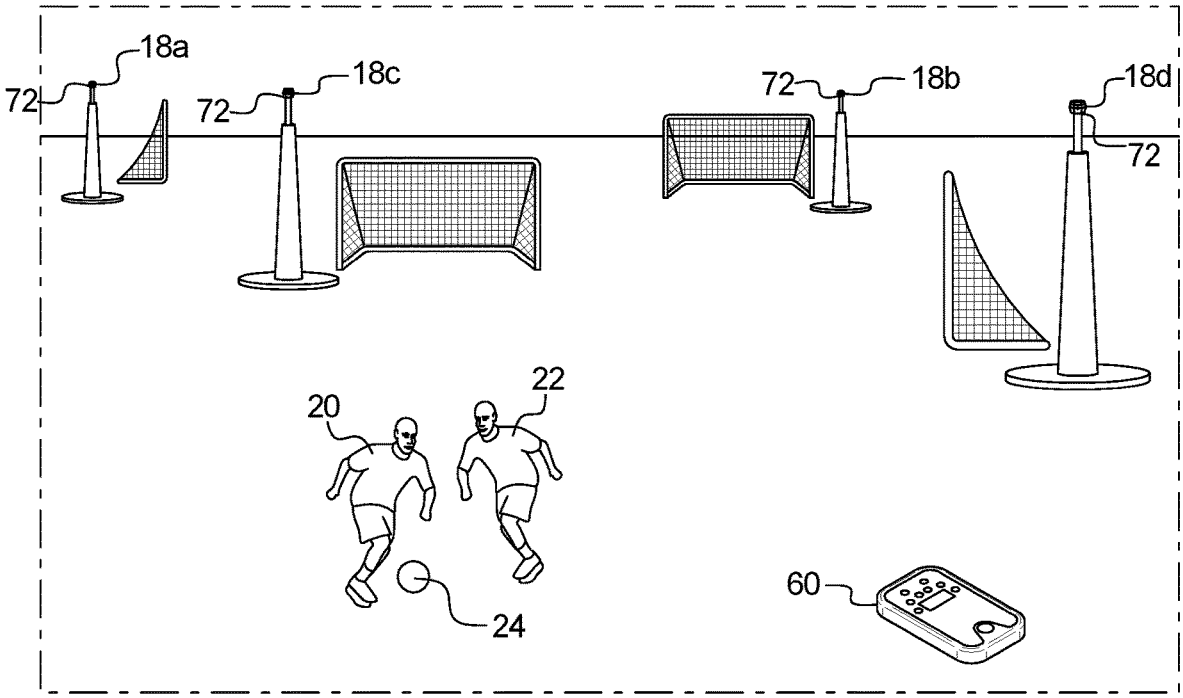
FIGS. 13*a*-13*c* illustrate a further application of a sports training system as a soccer training drill utilizing the remote control.
Figure 13B:
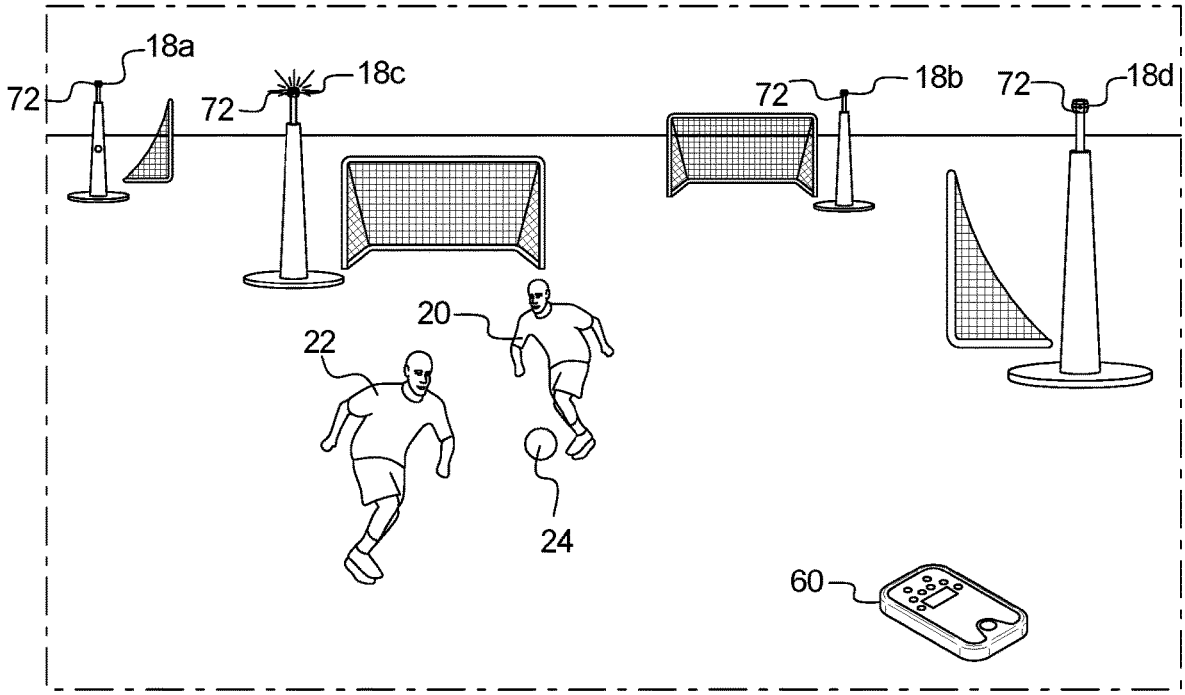
Figure 13C:
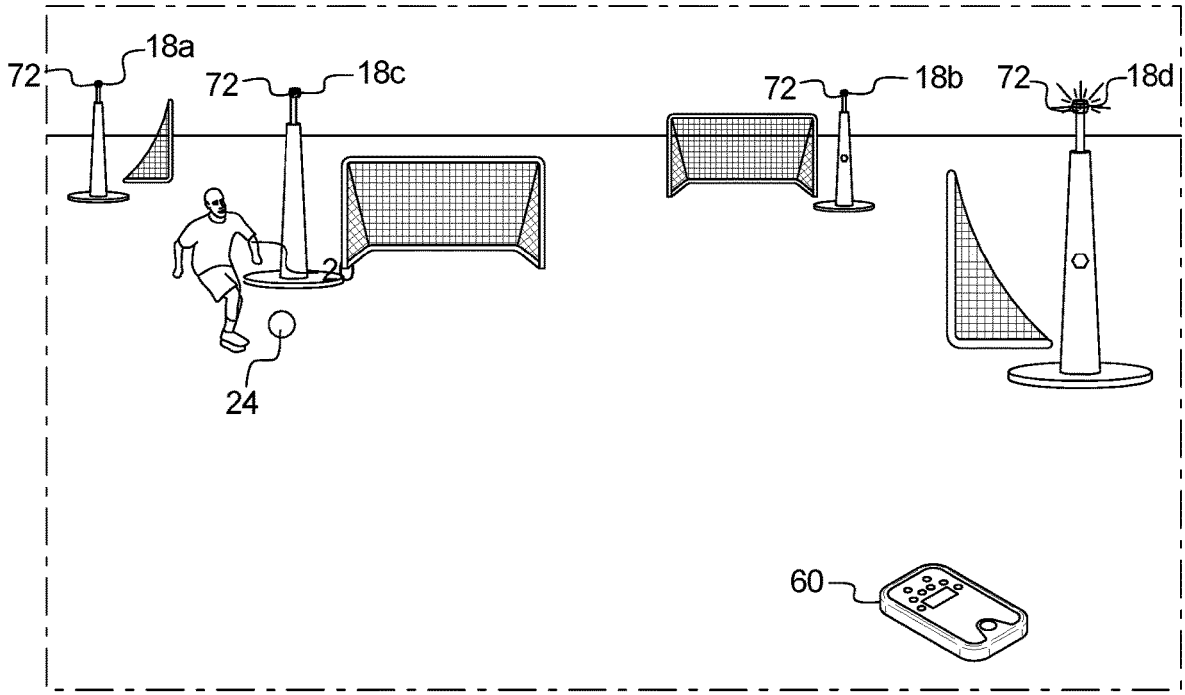

In some embodiments, the targets 18*a*-18*d* of the sports training system 10 include motion sensors 72 configured to detect movement of a player near an illuminated target 18*a*-18*d*. For example, in one embodiment of a pathing drill, once the player is directed towards an illuminated target 18*a*-18*d*, the illuminated target 18*a*-18*d* detects the presence of the player in the vicinity and causes a second target 18*a*-18*d* to be illuminated. The player then moves in the direction of the second illuminated target 18*a*-18*d*. The sequence of the illumination of the targets 18*a*-18*d* trains the player to correctly path (i.e., move in a useful pattern) through the series of targets 18*a*-18*d*. Each motion sensor 72 may be integrated into the light portion of the target 18 as shown in FIGS. 13*a*-13*c*. In other embodiments, the motion sensor 72 may be attached to the base or other portion of the target 18.

FIGS. 11*a*-13*c* illustrate examples of the sports training system 10 utilizing the remote control 60. As with FIGS. 7*a*-9*c* above, these examples are non-exhaustive and are provided to illustrate to those skilled in the art various ways in which the remote control 60 may be used with the sports training system 10.

Figure 11A:
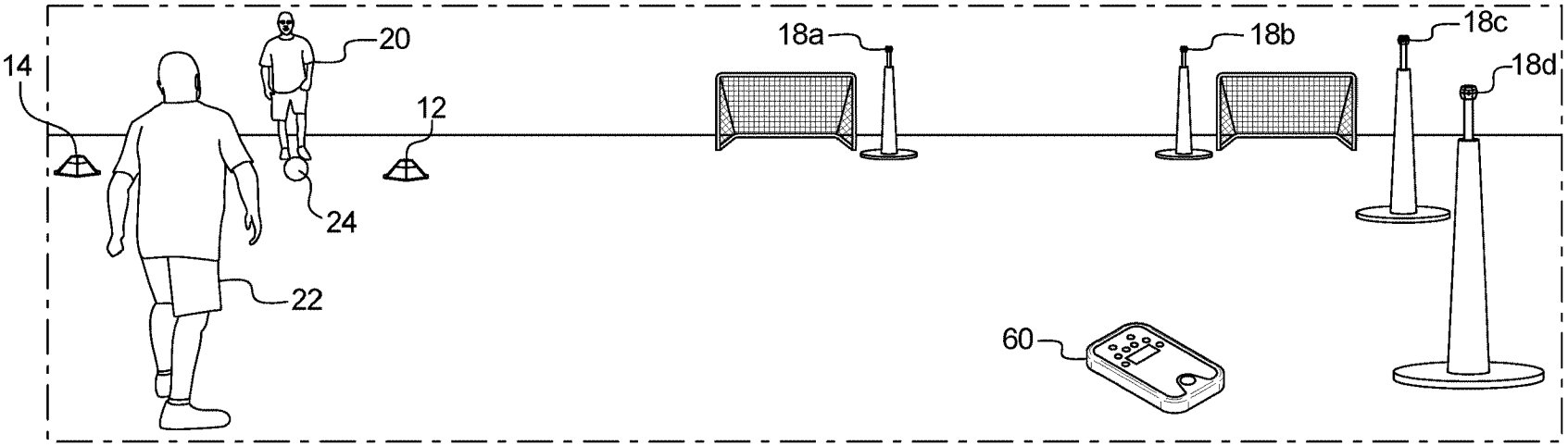
FIGS. 11*a*-11*c* illustrate an application of a sports training system as a soccer training drill utilizing the remote control.
Figure 11B:
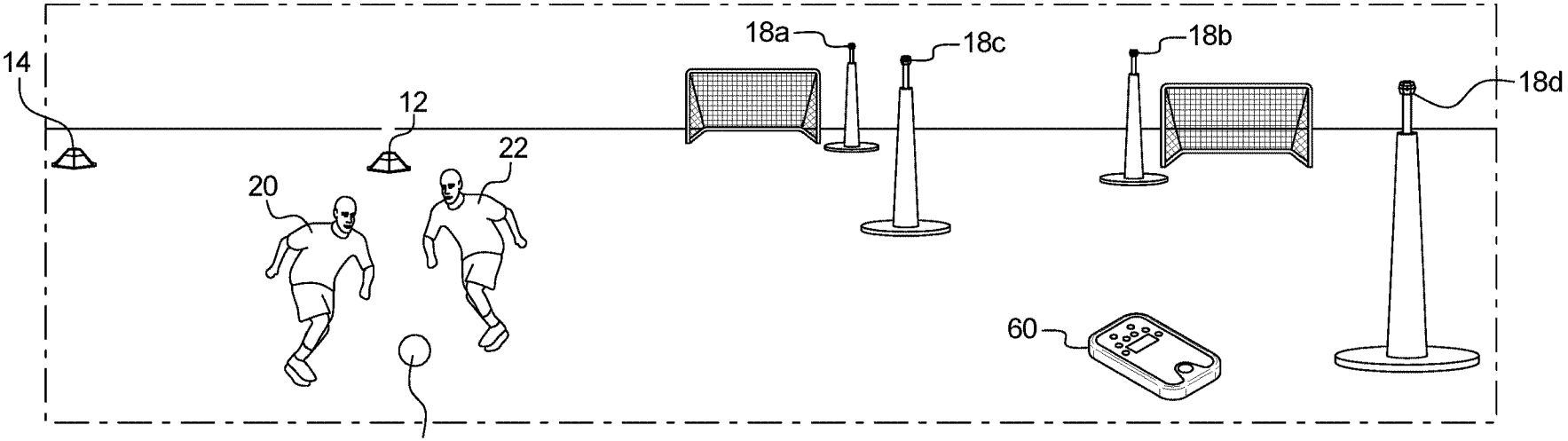
Figure 11C:
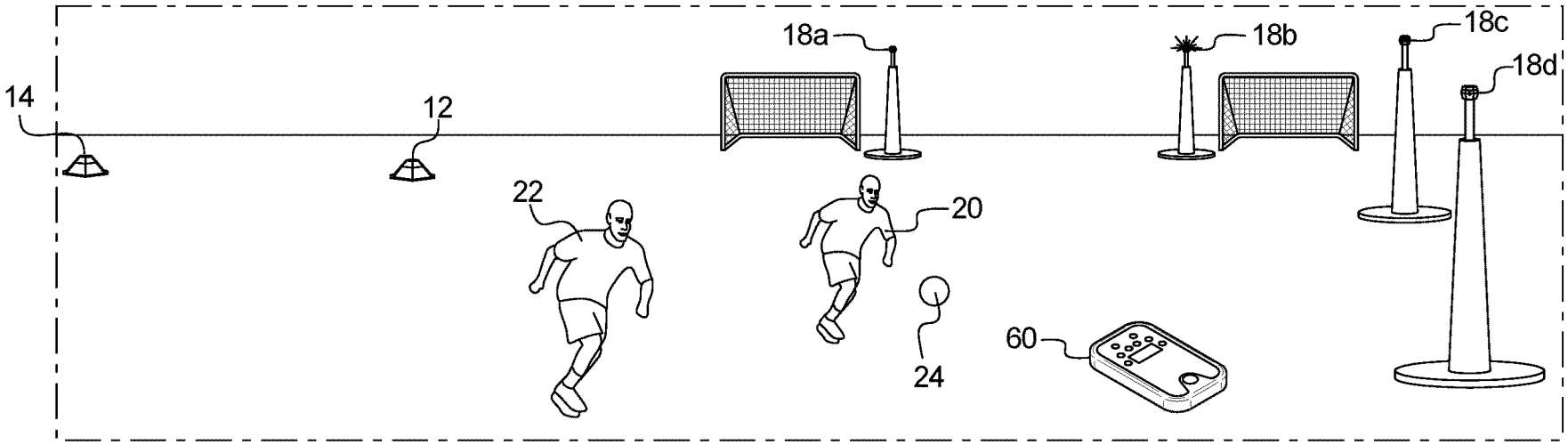

FIGS. 11*a*-11*c* illustrate the use of the remote control 60 to delay the illumination of a light 18*a*-18*d* upon triggering at the transmitter and receiver pair 12, 14. In the example shown in FIG. 11*a*, a first player 20 is positioned to pass the ball to a second player 22. The transmitter 12 and receiver 14 are positioned such that the pass from the first player 20 to the second player 22 trips the communication between the transmitter 12 and the receiver 14, thereby triggering the illumination of one of the four targets 18*a*-18*d*. In this example, however, a coach or other person has set a delay of six second between the triggering of the system and the lighting up of a light 18*a*-18*d* using the delay control 68*a*, 68*b* of the remote control 60.

After the ball is passed to the second player 22, the second player 22 advances the ball towards the two goals adjacent to the targets 18*a*, 18*b* and resists defense by the first player 20 during the delay in FIG. 11*b*. During the six-second delay, the second player 22 must protect the ball from the first player 20 while keeping his or her eyes up to see when one of the lights 18*a*, 18*b* has been illuminated. Once the six-second delay has ended, the target 18*b* is illuminated and the second player 22 immediately dribbles the ball towards the goal adjacent to the illuminated light 18*b* as shown in FIG. 11*c*.

In another example, the trigger system of the transmitter and receiver units 12, 14 is deactivated and the coach illuminates one of the four lights 18*a*-18*d* directly using the target activation controls 64*a*-64*d*. In one drill, the first and second players 20, 22 are passing the ball within a close range. The players 20, 22 must watch for the illumination of a target 18*a*-18*d*. When one of the targets is illuminated, the player 20, 22 in possession of the ball becomes the forward and the player 20, 22 without the ball becomes the defender, as the player 20, 22 moves toward the illuminated target 18*a*-18*d*.

Figure 12A:
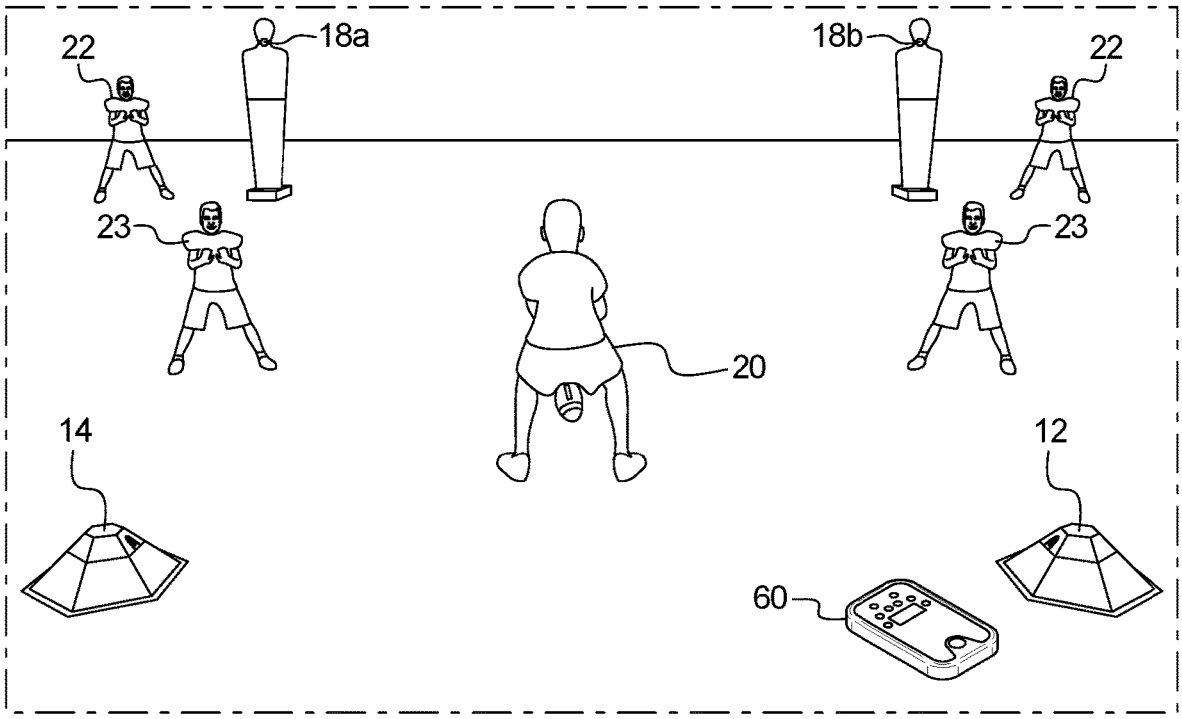
FIGS. 12*a*-12*c* illustrate an application of a sports training system as a football passing training drill utilizing the remote control.
Figure 12B:
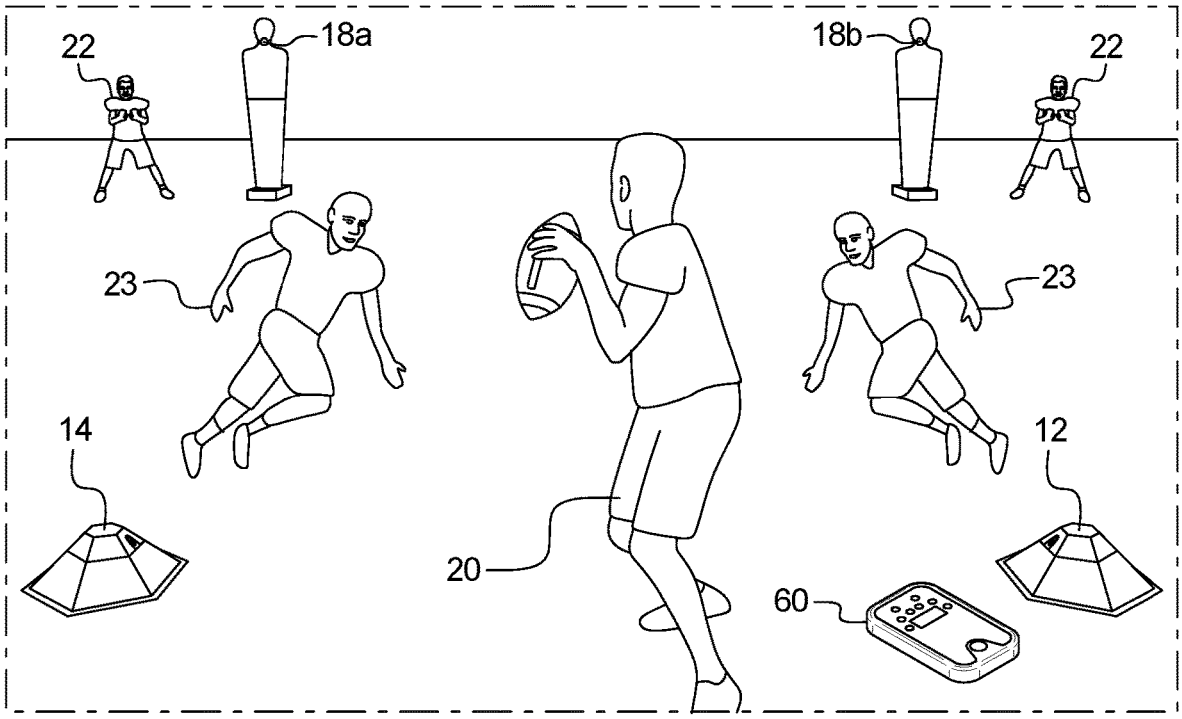
Figure 12C:
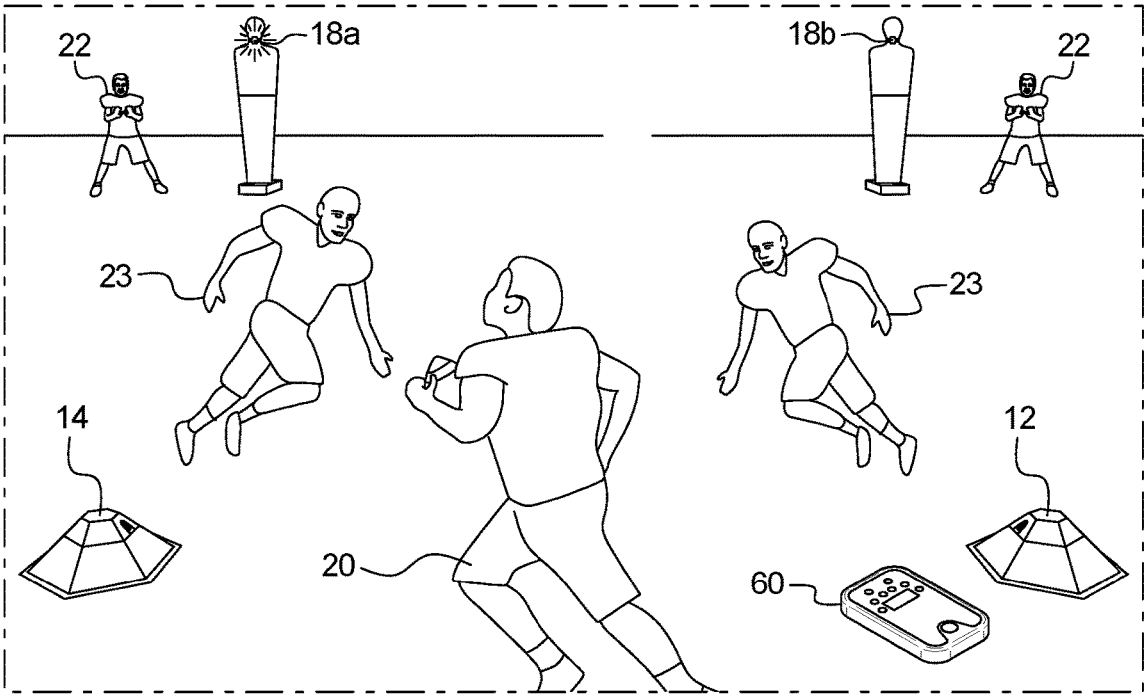

In a further embodiment illustrated in FIGS. 12*a*-12*c*, a delay has been added to the triggering of the transmitter and receiver pair 12, 14 using the delay controls 68*a*, 68*b* on the remote control 60. In this example, the transmitter 12 and receiver 14 are positioned such that as the first player 20 (e.g., the quarterback) drops back to pass, one of the two targets 18*a*, 18*b* is illuminated after the selected delay has transpired.

In FIG. 12*a*, the first player 20 drops back to pass the football to one of the two players 22 standing adjacent to the targets 18*a*, 18*b*. Two other defensive players 23 are in starting positions in formation. After the player 20 drops back as shown in FIG. 12*b*, the defensive players 23 move toward the first player 20, causing him to move in order to protect the football. During the delay, the player 20 must keep his eyes up in order to watch for the illumination of a target 18*a*, 18*b*. Once the target 18*a* is illuminated as shown in FIG. 12*c*, the player 20 passes the ball to the receiving player 22 positioned near the illuminated target 18*a*, 18*d*.

FIGS. 13*a*-13*c* illustrate the use of the remote control 60 to illuminate the targets 18*a*-18*d* directly and make use of the motion sensors 72 associated with the targets 18*a*-18*d*. In this example, the transmitter and receiver pair 12, 14 is deactivated. The coach observes the players playing one vs. one, two vs. one, or two vs. two, for example. Referring to FIG. 13*a*, the players are instructed to shield and dribble the ball 24 while keeping their heads up to monitor the targets 18*a*-18*d* until one of the targets 18*a*-18*d* is illuminated. When the coach illuminates target 18*b* through the remote control 60 as shown in FIG. 13*b*, the player in possession of the ball directs the ball to the goal adjacent the illuminated target 18*b*.

When the player in possession of the ball reaches the illuminated target 18*b* as shown in FIG. 13*c*, the motion sensor 72 on the illuminated target 18*b* detects the presence of the player in the vicinity and communicates the detection to the processor 32 of the system 10. In response to receiving the data, the processor 32 of the sports training system 10 then illuminates the next target 18*d*. The player then moves toward the next illuminated target 18*d*, where the sensor 72 associated with the target 18*d* detects the presence of the player. The detection of the player at the target 18*d* is communicated to the processor 32, and the processor 32 illuminates the next target, and so on.

In a more complex applications, the targets 18 may be smart targets 18 that track the activity by the users. For example, the targets 18 may include one or more sensors to track the user's accuracy in drills. In one example, each target 18 may include or be associated with a hoop, or similar goal, that identifies whether the ball 24 (or other object) has been passed through the goal in response to a corresponding visual indicator. Similarly, the target 18 may have proximity sensors to determine whether a user passes the target 18 in response to the visual indication. Such data observed and collected by the smart targets 18 may be communicated to the processor 32 and/or to the mobile application. The system may keep track of the player statistics and report to the mobile application, either directly through or via a cloud computing system, such that the users have a record of the player's performance over time. Any number of statistics may be tracked, including time of use, accuracy in the drills, etc.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A sports training system comprising:
- a first housing including a transmitter;
- a second housing including a receiver and a wireless communication module;
- a plurality of illuminating targets in communication with the wireless communication module; and
- a remote control in wireless communication with the transmitter, the receiver, and the plurality of illuminating targets;

wherein, in operation:
- the transmitter projects a transmission;
- the receiver is positioned laterally away from the transmitter and receives the transmission;
- in response to an object passing between the transmitter and receiver, the receiver is blocked from receiving the transmission;
- in response to the receiver being blocked from receiving the transmission, a selected one of the illuminating targets illuminates; and
- input from the remote control controls operation of one of the transmitter, the receiver, or one of the plurality of illuminating targets; and
- wherein illumination of at least one illuminating target is triggered by the object passing between the transmitter and the receiver and by manual operation of the remote control in combination.

2. The system of claim 1, wherein the input from the remote control activates or deactivates one of the transmitter, the receiver, and one or more of the illuminating targets.

3. The system of claim 2, wherein the input from the remote control stops the transmitter from projecting the transmission.

4. The system of claim 1, wherein the input from the remote control activates or deactivates one of the plurality of illuminating targets.

5. The system of claim 1, wherein, in operation, the selected one of the targets is illuminated immediately in response to the receiver being blocked from receiving the projected transmission.

6. The system of claim 1, wherein the input from the remote control generates a delay in the illumination of the selected one of the targets in response to the receiver being blocked from receiving the projected transmission.

7. The system of claim 6, wherein the delay has a length of between about 0 seconds and 9 seconds.

8. The system of claim 7, wherein further input from the remote control adjusts the length of the delay.

9. The system of claim 1, wherein the projected transmission is an infrared beam.

10. The system of claim 1, wherein the selection of one of the targets to illuminate is random or pseudo-random.

11. The system of claim 1, wherein the remote control is a mobile device.

12. The system of claim 1, wherein the selected illumination target has a duration of illumination between 1 second and 6 seconds.

13. A sports training system comprising:
- a first housing including a transmitter;
- a second housing including a receiver and a wireless communication module;

a multi-color indicator in communication with the wireless communication module;

a plurality of colored targets corresponding to the colors on the multi-color indicator;

a remote control in wireless communication with the transmitter, the receiver, and the multi-color indicator;

wherein, in operation:

the transmitter projects a transmission;

the receiver is positioned laterally away from the transmitter and receives the projected transmission;

in response to an object passing between the transmitter and receiver, the receiver is blocked from receiving the projected transmission;

in response to the receiver being blocked from receiving the projected transmission, a selected one of the colors on the multi-color indicator illuminates; and input from the remote control controls operation of one of the transmitter, the receiver, and the multi-color indicator; and wherein illumination of the multi-color indicator is triggered by the object passing between the transmitter and the receiver and by manual operation of the remote control in combination.

14. The system of claim 13, wherein the input from the remote control activates or deactivates the transmitter and the receiver.

15. The system of claim 14, wherein the input from the remote control stops the transmitter from projecting the transmission.

16. The system of claim 13, wherein the input from the remote control activates or deactivates the multi-color indicator.

17. The system of claim 13, wherein the input from the remote control generates a delay in the illumination of the multi-color indicator in response to the receiver being blocked from receiving the projected transmission.

18. The system of claim 17, wherein the delay has a length of between about 0 seconds and 9 seconds.

19. The system of claim 18, wherein further input from the remote control adjusts the length of the delay.

20. A method of using a sports training system, the method comprising the steps of:

providing a sports training system including:

a first housing including a transmitter;

a second housing including a receiver and a wireless communication module;

one of a plurality of illuminating targets or a multi-color indicator in communication with the wireless communication module and a plurality of colored targets corresponding to the colors on the multi-color indicator; and a remote control in wireless communication with the transmitter, the receiver, and the one of the plurality of illuminating targets or the multi-color indicator;

projecting a transmission from the transmitter to the receiver;

receiving the transmission in the receiver;

in response to an object passing between the transmitter and receiver, illuminating one of a target of the plurality of illuminating targets or the multi-color indicator; and controlling operation of one of the transmitter, the receiver, and the one of the plurality of illuminating targets or the multi-color indicator through input received by the remote control;

illuminating at least one illuminating target or the multi-color indicator in response to the object passing between the transmitter and the receiver and to manual operation of the remote control in combination.

* * * * *